US011141025B2

(12) United States Patent
Johnson et al.

(10) Patent No.: US 11,141,025 B2
(45) **Date of Patent: *Oct. 12, 2021**

(54) PRODUCT, SYSTEM, METHOD, APPARATUS, AND ARTICLE OF MANUFACTURE FOR SHOWER LINER STAY

(71) Applicants: William J. Johnson, Flower Mound, TX (US); Sophia Johnson, Flower Mound, TX (US)

(72) Inventors: William J. Johnson, Flower Mound, TX (US); Sophia Johnson, Flower Mound, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/786,805

(22) Filed: Feb. 10, 2020

(65) Prior Publication Data

US 2020/0170456 A1 Jun. 4, 2020

Related U.S. Application Data

(63) Continuation-in-part of application No. 16/296,180, filed on Mar. 7, 2019, now abandoned, which is a continuation-in-part of application No. 15/922,870, filed on Mar. 15, 2018, now Pat. No. 10,555,644, application No. 16/786,805, which is a continuation-in-part of application No. 15/922,870, filed on Mar. 15, 2018, now Pat. No. 10,555,644, which is a continuation-in-part of application No. 15/921,029, filed on Mar. 14, 2018, now abandoned.

(51) Int. Cl.
*A47K 3/38* (2006.01)
*A47H 99/00* (2009.01)

(52) U.S. Cl.
CPC ..... *A47K 3/38* (2013.01); *A47H 99/00* (2013.01)

(58) Field of Classification Search
CPC ..... A47K 3/38; A47H 99/00
USPC ..... 4/608
See application file for complete search history.

(56) References Cited

U.S. PATENT DOCUMENTS

| | | | |
|---|---|---|---|
| 4,777,673 | A | 10/1988 | Patteson et al. |
| 5,170,974 | A | 12/1992 | Ruggiero |
| 5,495,628 | A | 3/1996 | Logan |
| 5,732,420 | A | 3/1998 | Micciche |
| 5,771,504 | A | 6/1998 | Steiner |
| 5,894,642 | A | 4/1999 | Eberhardt |
| 6,510,566 | B2 | 1/2003 | Bryce |
| 6,789,279 | B2 | 9/2004 | Yarid |
| 8,151,385 | B2 | 4/2012 | Goskowski et al. |
| 8,826,471 | B1 | 9/2014 | Maddox |
| 8,875,770 | B1 | 11/2014 | Martin et al. |
| 8,898,872 | B2 | 12/2014 | Raymond |
| 9,635,984 | B2 | 5/2017 | Pierce |
| 2008/0184479 | A1 | 8/2008 | Bathurst |
| 2012/0227179 | A1 | 9/2012 | Beyda |

(Continued)

*Primary Examiner* — Tuan N Nguyen
(74) *Attorney, Agent, or Firm* — Isidore PLLC

(57) ABSTRACT

A shower liner stay for holding a shower liner away from the showering area while a person is taking a shower. The shower liner stay includes one or more pensile wands to dangle on the dry ingress outside of a shower liner and adjacent the shower liner while dangling from existing hook(s) or curtain rod. Strategically affixed to a pensile wand are one or more graspers for grasping the delicate impermeable flexible surface of a shower liner for keeping the shower liner in place regardless of strong aerodynamic conditions during a shower. Customary and normal operation of the shower liner remains.

20 Claims, 21 Drawing Sheets

(56) References Cited

U.S. PATENT DOCUMENTS

| | | | |
|---|---|---|---|
| 2013/0031717 | A1 | 2/2013 | Roland et al. |
| 2013/0061386 | A1 | 3/2013 | Vagliardo |
| 2013/0067704 | A1 | 3/2013 | Raymond |
| 2015/0223643 | A1 | 8/2015 | Mason |
| 2016/0106251 | A1 | 4/2016 | Ramey |
| 2016/0135650 | A1 | 5/2016 | Ramey |
| 2017/0202404 | A1 | 7/2017 | Pandaleon |
| 2017/0290468 | A1 | 10/2017 | Raymond |
| 2018/0014698 | A1 | 1/2018 | Barrett |
| 2018/0344099 | A1 | 12/2018 | Gross |

PRODUCT, SYSTEM, METHOD, APPARATUS, AND ARTICLE OF MANUFACTURE FOR SHOWER LINER STAY

CROSS-REFERENCES TO RELATED APPLICATIONS

This application is a continuation in part and claims benefit of application Ser. No. 15/922,870 filed Mar. 15, 2018 and entitled "Product, System, Method, Apparatus, and Article of Manufacture for Shower Liner Stay" which is a continuation in part and claims benefit of application Ser. No. 15/921,029 filed Mar. 14, 2018 and entitled "Product, System, Method, Apparatus, and Article of Manufacture for Shower Liner Stay". This application is also a continuation in part and claims benefit of application Ser. No. 16/296,180 filed Mar. 7, 2019 and entitled "Product, System, Method, Apparatus, and Article of Manufacture for Shower Liner Stay" which is a continuation in part and claims benefit of application Ser. No. 15/922,870 filed Mar. 15, 2018 and entitled "Product, System, Method, Apparatus, and Article of Manufacture for Shower Liner Stay" which is a continuation in part and claims benefit of application Ser. No. 15/921,029 filed Mar. 14, 2018 and entitled "Product, System, Method, Apparatus, and Article of Manufacture for Shower Liner Stay". The aforementioned applications are hereby incorporated by reference in their entirety as though fully and completely set forth herein.

TECHNICAL FIELD

The present disclosure relates generally to bathtub and shower products, and more specifically to a system designed to hold a shower liner away from the showering area while a person is taking a shower.

BACKGROUND

A shower liner is frequently used to keep running water within a bathtub during a shower. A shower liner typically has up to twelve grommet holes at the top, and it hangs from a set of hooks that each engages with a grommet hole. The shower liner collectively hangs at a slight angle into the tub from a curtain rod installed above the outer edge of the bathtub, and may share the hooks with a shower curtain, which is a second hanging end to end (e.g. wall to wall for length of bathtub) flexible sheet of material (like shower liner) frequently used for decorative or aesthetic purposes. The decorative shower curtain is typically on the outside (dry side) of the bathtub, and the shower liner remains inside the bathtub. Due to the flow of water and air during a shower, in particular with recent advancements in water saving and high pressure showerhead designs, the shower liner tends to swell inwardly toward the showering area, which is the area within a bathtub where a person stands during a shower. The shower liner can swell inwardly and occupy space in the showering area thereby interfering with an enjoyable shower. The shower liner may also touch, or cling to, the body of the person taking a shower. This is an annoying situation for the person standing in the tub, and interferes with a timely shower.

Prior solutions are generally inadequate to keep the shower liner away from the showering user. Magnets placed at the shower liner bottom edge are useful, but do not keep the shower liner from swelling with air onto the person taking a shower when a high pressure showerhead is used.

Other solutions with some effectuality are bulky, and expensive to manufacture, package and ship. Customary and convenient operation of the decorative shower curtain and liner, for example when collapsing or opening using existing solutions, will be negatively affected. A heavy shower liner is cost prohibitive when compared to very inexpensive and thin disposable or washable shower liners. A low cost, completely effective product, system, method, apparatus, and article of manufacture is needed for keeping an inexpensive shower liner in place.

SUMMARY

The present disclosure is a product, system, method, apparatus, and article of manufacture implemented to hold a shower liner away from the showering area while a person is taking a shower (i.e. a shower liner stay). Disclosed are embodiments for the shower liner stay and components thereof. In preferred embodiments, the shower liner stay includes at least one pensile wand to dangle on the dry ingress outside of a shower liner and adjacent the shower liner while hanging from the existing hook(s) or curtain rod. Affixed to a pensile wand is at least one grasper (preferably adjustable) for grasping the delicate impermeable flexible surface of a shower liner for keeping the shower liner in place during a shower. Customary and normal operation of the shower liner remains unaffected by a shower liner stay installation. Depending on an embodiment, the grasper may be completely or partially embodied on the outwardly facing ingress side (i.e. the dry side) of the shower liner. In other embodiments, the grasper includes a shower liner stay grasper portion (i.e. a coupling member) on the inwardly facing egress side (i.e. the wet side) of the shower liner for grasping the shower liner by providing a sandwich coupling. A shower liner stay pensile wand preferably hangs with a shower liner stay pendent terminator for hanging from an existing curtain rod or existing hook.

Many advantages of the present disclosure are found through implementing a variety of embodiments for a shower liner stay without departing from the spirit and scope of the disclosure. In magnetic coupling embodiments, small magnets can be installed to the showering wet side of the shower liner for being inconspicuous, or large magnetic integrated teething-able objects can be installed to the showering wet side of the shower liner for being safe for a young child. In mechanical coupling embodiments, there are many different embodiments of graspers and alternatively matching grasper portions (i.e. coupling members on inside egress and wet side of shower liner) to enable a coupled engagement for sandwiching the shower liner, some tiny for being inconspicuous, some decorative, and some that ensure a child is safe from a choking hazard.

One aspect of some embodiments is in providing a very low cost solution as: comprised by a product, mailing of the product, and maintaining of the product. Practical solutions are manufactured inexpensively. Also, an inexpensive article of manufacture (e.g. a product) can be conveniently packaged for minimum cost mailing because of component length and light weight. Shower liner stay components (i.e. pensile wand(s), grasper(s) (and grasper portion(s) if applicable), pendent terminator(s), connector(s) if applicable, padding entity(s) if applicable, adhesive component(s) if applicable, and any other components included in product packaging) can be controllably manufactured for minimizing the length, weight, and dimensions of pensile wands and other components to minimize mailing and shipping costs.

Another aspect of some embodiments is in producing many embodiments for decorative purposes, personal tastes, and competing licensable products to create a new market category for shower liners as advancements become popular in high pressure showerheads, as well as inexpensive micro-thin disposable shower liners. The shower liner stay is designed and implemented with a variety of available materials and in a variety of different configurations. Choices enable competitive pricing, products meeting individual tastes or preferences, and performance criteria to be applied to a specific subset of shower liner stay features.

Another aspect of some embodiments is in producing a very simple product for installation and subsequent maintenance. Product instructions are brief. No tools or glues are required for assembly in many preferred embodiments. Some embodiment products can be packaged as components convenient for assembly. Product installation is very easy and quick while preventing future maintenance by remaining without modification completely on the dry outside of the shower liner. For embodiments using wet side grasper portion(s), the wet side grasper portions are removable when cleaning or replacing a shower liner, and they are at a height requiring little to no cleaning (unlike magnets installed at filthiest part bottom corners/edges of existing shower liners).

Another aspect of some embodiments is in maintaining existing aesthetics of an existing shower installation, in particular the most commonly used installation of a shower liner and outside decorative shower curtain used together. Shower liner stay pensile wands dangle on the dry ingress outside (i.e. user ingress to Bathtub/shower) of the shower liner, and between a decorative shower curtain and the shower liner so they are hidden from view. In grasper-only embodiments for using the decorative shower curtain for support, graspers may be hidden from views. A pensile wand together with a pendent terminator is preferably less in length than a standard 72" tall shower liner and shower curtain for also being undetected at the base of the shower liner or shower curtain. The preferred length of a pensile wand together with a pendent terminator is also suitable in operation of handling taller (e.g. 78" tall) shower liners/curtains. A plurality of pensile wands dangling adjacent the shower liner is hidden from the outside view (i.e. view from ingress side to bathtub/shower/liner, outwardly side of bathtub/shower/liner, dry side of bathtub/shower/liner, user entry side of bathtub/shower/liner) of the bathtub/shower when a decorative shower curtain is in use. The plurality of pensile wands dangling adjacent the shower liner is also virtually hidden for many shower liners from the inside view (i.e. view from egress side to bathtub/shower/liner, inwardly side of bathtub/shower/liner, wet side of bathtub/shower/liner, user exit side of bathtub/shower/liner, showering area side of bathtub/shower/liner).

Other aspects of some embodiments include minimizing weight to an existing curtain rod and minimizing space used adjacent the shower liner. Pensile wands and other components are constructed of lightweight, yet rigid, material to accomplish objectives. In fact, the shower liner is easily collapsed or spread out without affecting operation, as though there were no shower liner stay installed.

Another aspect of some embodiments is in providing flexible adjustability of points where a shower liner is held in place. Recent advancements in water conservation have resulted in high pressure showerheads causing excessive movement and swelling of shower liners. Furthermore, advancements in shower liner materials have resulted in very thin and inexpensive materials which are disposable, machine washable, tolerant of lengthy periods of use without mold or mildew, yet are highly responsive to undesirable aerodynamic conditions during a shower. Undesirable aerodynamic shower situations are affected by very thin impermeable shower liners, showerhead varieties such as high pressure showerheads, bathroom fan exhaust operation, showerhead settings, air conditioning vent locations and operation, bathroom architectures, window openings, combinations thereof, and other variables that may cause the shower liner to interfere with taking an enjoyable shower. Graspers (and coupled grasper portions in some embodiments) may be uniquely and adjustably located for keeping the shower liner against pensile wands (or adjacent a decorative shower curtain) at the best shower liner points given unique and particular aerodynamic showering conditions. Shower liners will remain reasonably in place without negatively impacting a shower, and without negatively impacting normal shower liner/curtain operation.

A further aspect of some embodiments is prevention of interfering with normal operation of a typical shower liner installation, with or without a decorative shower curtain. After installation in accordance with this disclosure, the shower liner (and shower curtain) can be spread out for taking an enjoyable shower, and can be thoroughly collapsed when not taking a shower. A completed installation requires no further action on the part of a shower user. A completed installation becomes one with the shower liner in operation.

Another aspect of some embodiments is minimal maintenance. In some embodiments, most, if not all, of the shower liner stay is installed on the dry outside of the shower liner for never requiring being cleaned. In fact, pensile wands and components thereof installed between the shower liner and decorative shower curtain are thoroughly protected from even getting dusty. Graspers can be completely embodied on the dry outside of the shower liner. In embodiments when grasper portions on the wet inside of the shower liner are used, the grasper portions are removable for being cleaned, for example when cleaning, washing, or replacing a shower liner. Grasper portions (if used) are also located for avoiding the bottom dirtiest shower liner locations.

Another aspect of some embodiments is in supporting the installation of high pressure showerheads designed to conserve water by lessening a Gallons Per Minute (GPM) rating or by mixing air with water output. High pressure showerheads cause significant swelling and movement in thin shower liners. However, the benefits of high pressure showerheads cannot be overlooked, not only in water conservation, but in significantly less time needed to take a shower by blasting away suds. Many people are frustrated waiting for a low pressure showerhead to thoroughly rinse away suds during a shower. Most people would like the option to save time taking a shower.

Yet another aspect of some embodiments is in consumer convenience. People can purchase very inexpensive super lightweight shower liners that will not interfere with taking a shower. The present disclosure saves significant cost over the life of a user, not to mention saving time: taking showers, replacing low cost disposable shower liners, and maintaining a permanent high quality showering experience.

DESCRIPTION OF DRAWINGS

The above and further aspects of this disclosure are discussed with reference to the following description in conjunction with the accompanying drawings, in which like numerals indicate like structural elements and features in various figures. A drawing in which an element first appears is indicated by the leftmost digit(s) in the corresponding reference number. There is no guarantee there are descriptions in this specification for explaining every novel feature found in the drawings. The figures depict one or more implementations by way of example only, not by way of limitation.

DETAILED DESCRIPTION

Figure 1A:
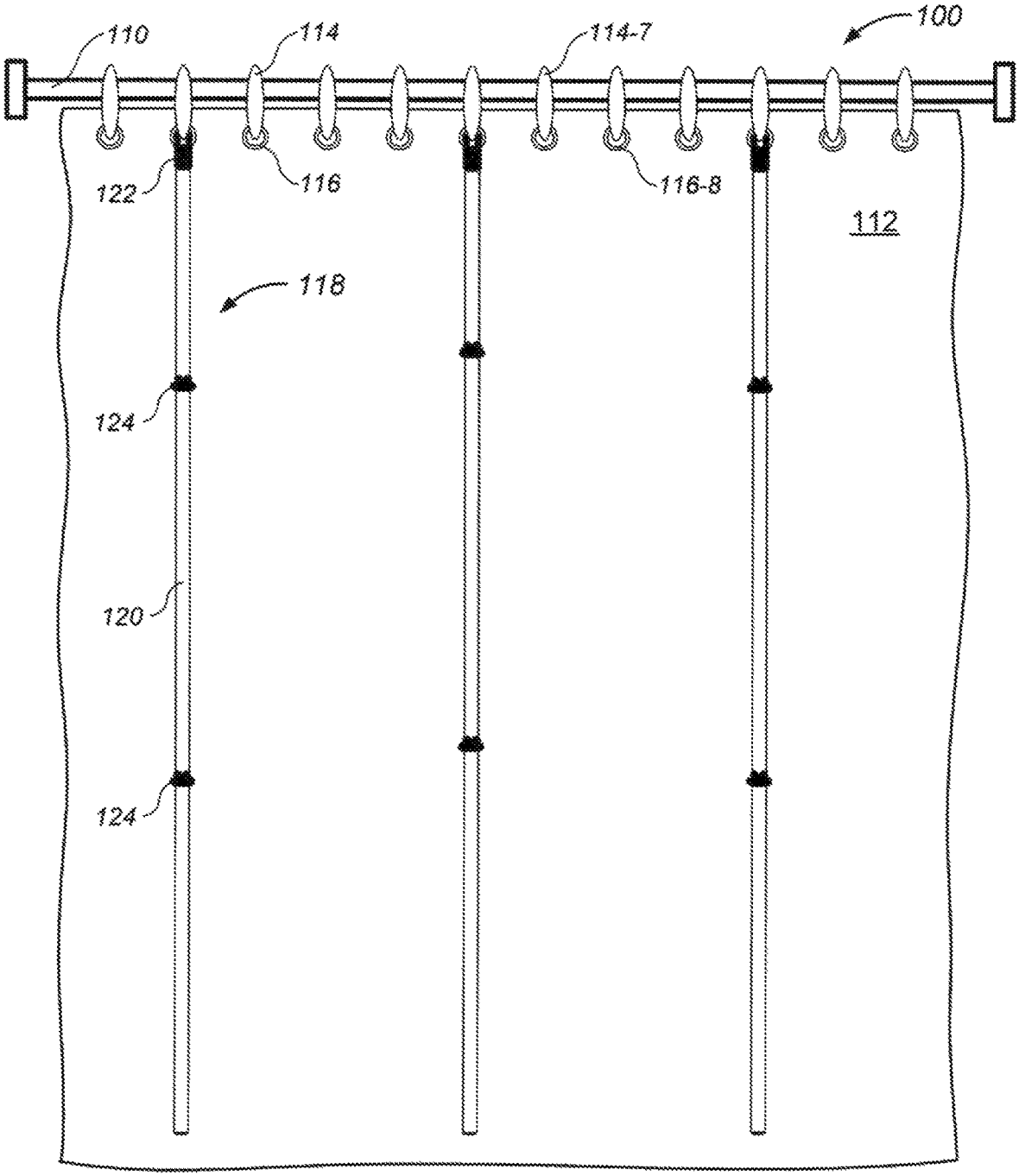
FIG. 1A depicts an embodiment installation of the present disclosure.

With reference now to detail of the drawings, the present disclosure is described. Novel features disclosed herein need not be provided as all or none. Certain features may be isolated in some embodiments, or may appear as any subset of features and functionality in other embodiments.

A delicate, flexible, thin-walled, lightweight, impermeable shower liner is kept away from a user of a shower by using an otherwise unusable surface of the shower liner (i.e. using the unprepared, unaltered, flexible and impermeable surface of shower liner). Disclosed embodiments herein grasp (e.g. grip, grab, clasp, clutch, couple to, stick to, fasten to, hold in place, or the like) the shower liner to keep it away from the user of the shower.

A shower liner stay preferably includes a plurality (e.g. 2 or 3) of shower liner stay pensile wands for dangling (an alternate embodiment hangs securely, for example in a fixed movement in one or more directions) on the dry outside of a shower liner and adjacent the shower liner while hanging from the existing curtain rod, or preferably the hook(s), with respective shower liner stay pendent terminators. Adjustably affixed to shower liner stay pensile wands is one or more shower liner stay graspers for grasping (e.g. gripping, grabbing, clasping, clutching, coupling, sticking to, fastening to, holding, sandwiching, or the like) the shower liner.

In one magnetic coupling embodiment, a grasper is a ferromagnetic spring steel clamp (or clip) that can be adjustably located anywhere along the pensile wand on the dry side of the shower liner (terminology "dry side" refers to the dry side of shower liner 112 such as shower user ingress/entry side to bathtub/shower/liner, outwardly side of bathtub/shower/liner, outside side of bathtub/shower/liner, opposite the showering area side of bathtub/shower/liner), and once positioned will stay in place through the spring steel compression to the pensile wand. Further, the grasper includes a shower liner stay grasper portion on the wet side of the shower liner (terminology "wet side" refers to the wet side of shower liner 112 such as shower user egress/exit side from bathtub/shower/liner, inwardly side of bathtub/shower/liner, inside side of bathtub/shower/liner, showering area side of bathtub/shower/liner) which is a magnet for being magnetically attracted to a respective adjacent adjustable ferromagnetic member (i.e. the spring steel clamp (or clip)). Force exerted by the magnet to the ferromagnetic member (e.g. metal clamp (or clip) containing iron, nickel, and/or cobalt) sandwiches the shower liner to keep it in place regardless of strong aerodynamic conditions during a shower. Alternatively, one or more adjustable clamp (or clip) integrated magnetic graspers affixed to the pensile wand attract a ferromagnetic grasper portion (e.g. metallic coupling member or object) on the wet side of the shower liner for similarly sandwiching the shower liner. In another embodiment, both grasper and grasper portion are magnetic, magnets, or components having integrated magnets.

In one mechanical coupling embodiment, a grasper is at least one receiving snap socket manufactured as integrated impression(s) at point(s) on a pensile wand (e.g. formed as one pensile wand, or adapted to pensile wand), or adjustably affixed to a pensile wand for being located anywhere along the pensile wand (e.g. with a compression or spring fit to the pensile wand). In this example, the grasper portion is a snap stud object placed on the wet side of the shower liner for being snapped into a dry side snap socket. This snap engagement keeps the shower liner in place regardless of strong aerodynamic conditions during a shower by using a mechanically held snap to sandwich the shower liner (i.e. with a male/female engagement, coupling engagement, or the like for sandwiching the shower liner). There are a variety of snap designs for a mechanical engagement not causing damage to a shower liner (i.e. male/female component engagements, grasper and grasper portion couplings, etc. such as integrated dry side snap (male/female and coupling) engagement points integrated on pensile wand for coupling with matching wet side grasper portion(s), integrated dry side coupling places integrated on pensile wand for coupling with matching wet side grasper portion(s), existing dry side coupling circumference of pensile wand for snap coupling with matching wet side grasper portion(s) (e.g. C clips (i.e. compression fit object)), objects placed on pensile wands that couple to objects (grasper portion(s)) placed on wet side of the shower liner, and the like). Rod circumference itself provides engagement points/places for snap of a C clip, for example to sandwich the shower liner when the C clip is installed to the wet side of the shower liner, thereby holding it in place. Alternatively, one or more snap stud graspers are similarly integrated protuberance(s) at point(s) on a pensile wand (e.g. formed as one pensile wand, or adapted to pensile wand), or adjustably affixed to a pensile wand as described above, in which case a grasper portion is a snap socket object placed on the wet side of the shower liner for similarly sandwiching the shower liner in place.

Of course, any of the exemplary component embodiments herein may be used to make a shower liner stay support member embodiment (e.g. feature integrated pensile wand) having all or any subset of other component embodiments described (e.g. pendent terminator, grasper(s), padding entity) as integrated features, for example, a single pensile wand component manufactured in a configuration having a loop or hook at top, one or more graspers along the body, and a larger or softer bottom end (i.e. support member a single manufactured component having at least one of the other component functionalities integrated thereon (e.g. loop/hook top and ferromagnetic places as part of pensile wand 120)). Another example is support member 118 having ferromagnetic paint, or magnetic particle paint, painted thereon (e.g. to pensile wand 120) for conveniently located magnetic attraction places. Similarly, ferromagnetic or magnetic glues, tapes, materials, or the like may be provided to support member 118 (e.g. pensile wand 120).

One preferred shower liner stay product disclosed herein consists of a barcode marked package containing installation instructions, advertisement collateral (e.g. packaging header with title "Shower Liner Stay" and advertisement picture facilitating immediate product understanding), and the following shower liner stay components: at least one shower liner stay pensile wand (3 in number being optimal), a shower liner stay pendent terminator for each wand, at least one shower liner stay grasper for each wand (2 in number per pensile wand being optimal) and any applicable shower liner stay grasper portions required, any applicable shower liner stay pensile wand connectors, any applicable shower liner stay padding entities, any applicable shower liner stay skeletal links, and any other applicable components (i.e. parts, pieces, or the like) described below for making a shower liner stay. It will become apparent upon reading the Figure descriptions what each of the components entail. Components are preferably child safe (except for inconspicuous embodiments for adult use), water-proof or at least water resistant (e.g. zinc plated, plastic/rubber coated, or the like), lightweight, and inexpensive. Wherever possible, components are preferably white, clear, or translucent for a clean look, but any colors, dimensions, shapes, profiles, and materials may be used.

A component is defined as "child safe" by being appropriately sized to prevent being a choking hazard, and to be manufactured of a material safe for being touched, chewed, or abused. Components should be child safe, except where product identified as not meeting child safe requirements.

The terminology "plastic" used herein refers to any of the wide range of synthetic or semi-synthetic organic compounds that can be molded into solid objects, for example amorphous thermoplastics (ABS, Acrylic, Kydex, Noryl, PETG, Polycarbonate, Polystyrene, Polysulfone, PVC, Radel, Ultem, or the like), semicrystalline thermoplastics (Acetal, HDPE, LDPE, Nylon, PBT, PEEK, PET, Polyupropylene, PPS, PTFE, PVDF, UHMW-PE, or the like), imidized materials (Polyamide-imide, Vespel Polyimide, or the like), and any like plastic, material, composite, foam, mixture, alloy, or combinatory formula thereof (e.g. to achieve desired chemical makeup, flexibility, durometer measurement, pigment, or any other characteristic). Preferred embodiments of components are manufactured using a plastic, however components may be manufactured using any physical material (referred to simply as "material") such as metal, wood, glass, plastic, rubber, fiber, string, cord, strap, wire, paper, cardboard, organic material, inorganic material, synthetic material, or any other suitable substituted material for carrying out forming (e.g. making, molding, printing, extruding, or any other manufacture) of a component of this disclosure.

The reader shall be eased into one exemplary embodiment of FIGS. 1A through 1E to establish a foundation understanding before introducing various component embodiments. With reference to FIG. 1A, depicted is an embodiment installation of the present disclosure, for example a magnetic coupling embodiment. A shower liner stay installation 100 involves a curtain rod 110 (walls not shown) hanging an impermeable shower liner 112, usually by use of shower liner/curtain hooks 114 placed through shower liner grommet holes 116. There are many varieties of shower liner holes 116, with or without formal grommets, or manufactured with various grommet-like reinforcement (e.g. overlapped material). There are many varieties of hooks 114 such as clasps, binds, loops, ties, or even holes 116 designed to be threaded directly by the curtain rod 110. Terminology "hooks 114" include all hook/hanger types. There are also various curtain rod designs: telescopic, straight, curved, different shapes, different profiles, colors, sizes, designs, etc. The shower liner stay disclosed herein is designed to work with all shower liner hanging embodiments.

The typical shower liner installation depicted by FIG. 1A has a plurality of hooks 114 (e.g. 12 of them), referenced from left to right as hook 114-1, hook 114-2, . . . , hook 114-12, respectively. Hook 114-7 is the seventh hook from the left of the illustration. Similarly, there are respective shower liner holes 116, referenced from left to right as hole 116-1, hole 116-2, . . . , hole 116-12, respectively. Hole 116-8 is the eighth hole from the left of the illustration. Depending on aerodynamic conditions of a particular shower liner stay installation 100, one or more shower liner stay support members 118 (e.g. pensile wand 120+applicable components thereon) are installed. There may be one shower liner stay support member 118 installed by dangling directly from curtain rod 110, for example between hook 114-6 and hook 114-7 for symmetric appeal, or from hook 114-6 or 114-7 that is adjacent hole 116-6 or 116-7. In a two support member 118 installation, support members 118 may dangle directly from the curtain rod 110, for example between hooks 114-4 and 114-5, as well as between hooks 114-8 and 114-9, or from hooks 114-4 and 114-9 that is adjacent holes 116-4 and 116-9, for symmetric appeal. Depicted is a shower liner stay installation 100 wherein three shower liner stay support members 118 dangle from hooks 114-2, 114-6 and 114-10 that are adjacent holes 116-2, 116-6, and 116-10. While not symmetrical with respect to the shower liner, many shower liner conditions involve a stronger side aerodynamic condition to be controlled, or involve preferences by users based on entering/exiting the shower, or preferences for collapsing the shower liner. When used with a decorative shower curtain (not shown), symmetry for appearance is not of concern because support members 118 are unnoticeable. However, three support members 118 may dangle from curtain rod 110 itself for a true symmetrical install, or only the middle support member 118 could dangle from the rod itself between hooks 114-6 and 114-7 while left and right support members dangle from hooks 114-3 and 114-10 that is adjacent holes 116-3 and 116-10. In a four support member 118 shower liner stay installation 100, support members 118 may dangle directly from curtain rod 110 or from hooks 114 in a symmetrical manner similarly spread out as discussed above. It is up to the user where to dangle shower liner stay support members 118, and the shower liner stay product preferably provides shower liner stay pendent terminator(s) that can hang from either hooks 114 or curtain rods 110. Pendent terminator(s) may use their own dedicated hook (e.g. between hooks 114 used by shower liner 112), have an integrated hook (or loop or the like as discussed herein), or hang from an adapted hook to the curtain rod 110. Preferably, pendent terminator(s) share a hook 114 used by shower liner 112. Testing demonstrates that more than four support members 118 is not necessary, and as little as two support members solves most swelling problems for most shower installations. However, any number of support members may be implemented, or packaged as a product. Three support members 118 is a recommended product packaging to solve undesirable aerodynamic shower conditions for world population shower liner stay installations 100. A consumer can determine using one, two or three support members 118 after receiving the product containing 3 support members.

Figure 1B:
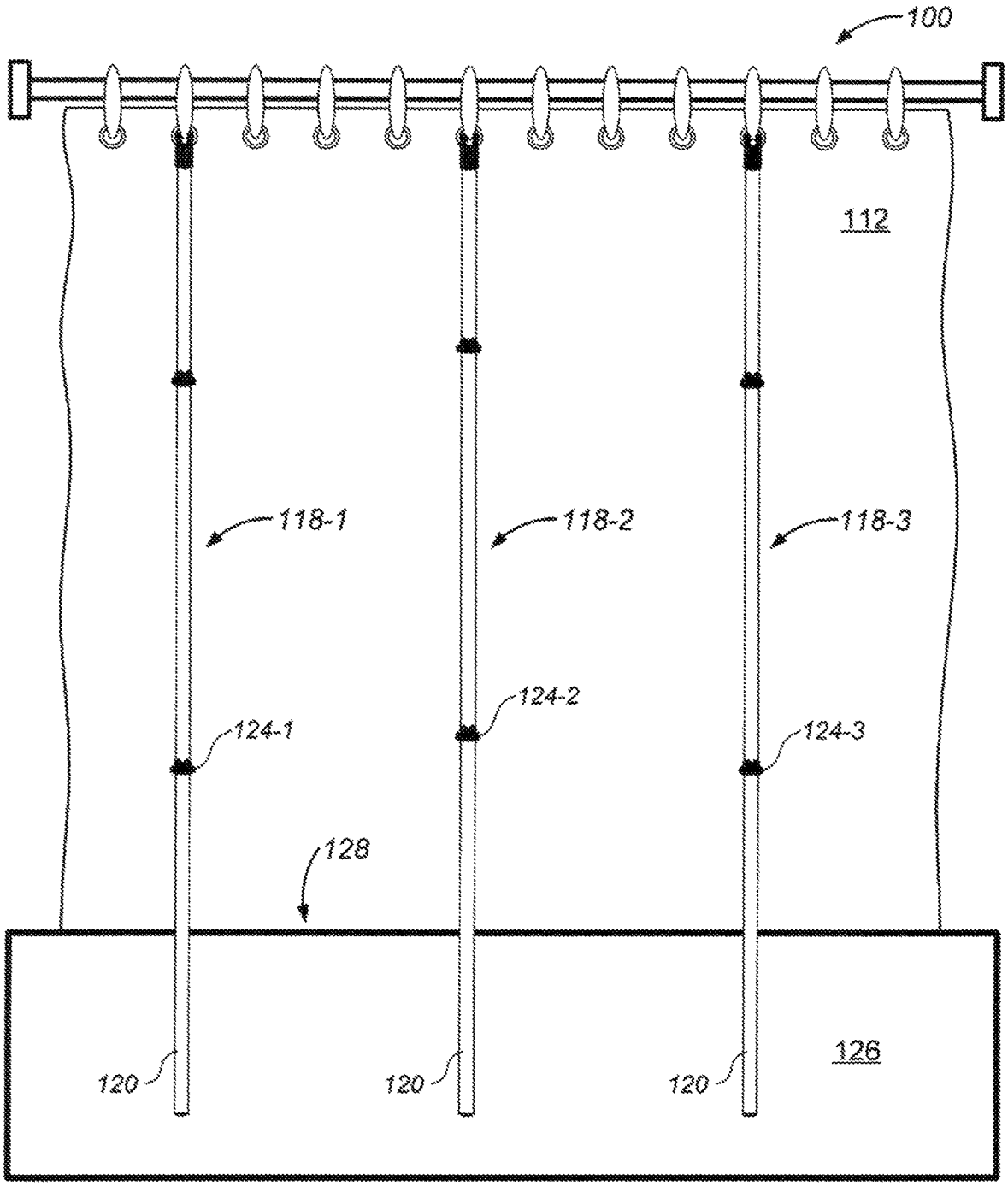
FIG. 1B depicts the embodiment installation of FIG. 1A with respect to a shower equipped bathtub.
Figure 1C:
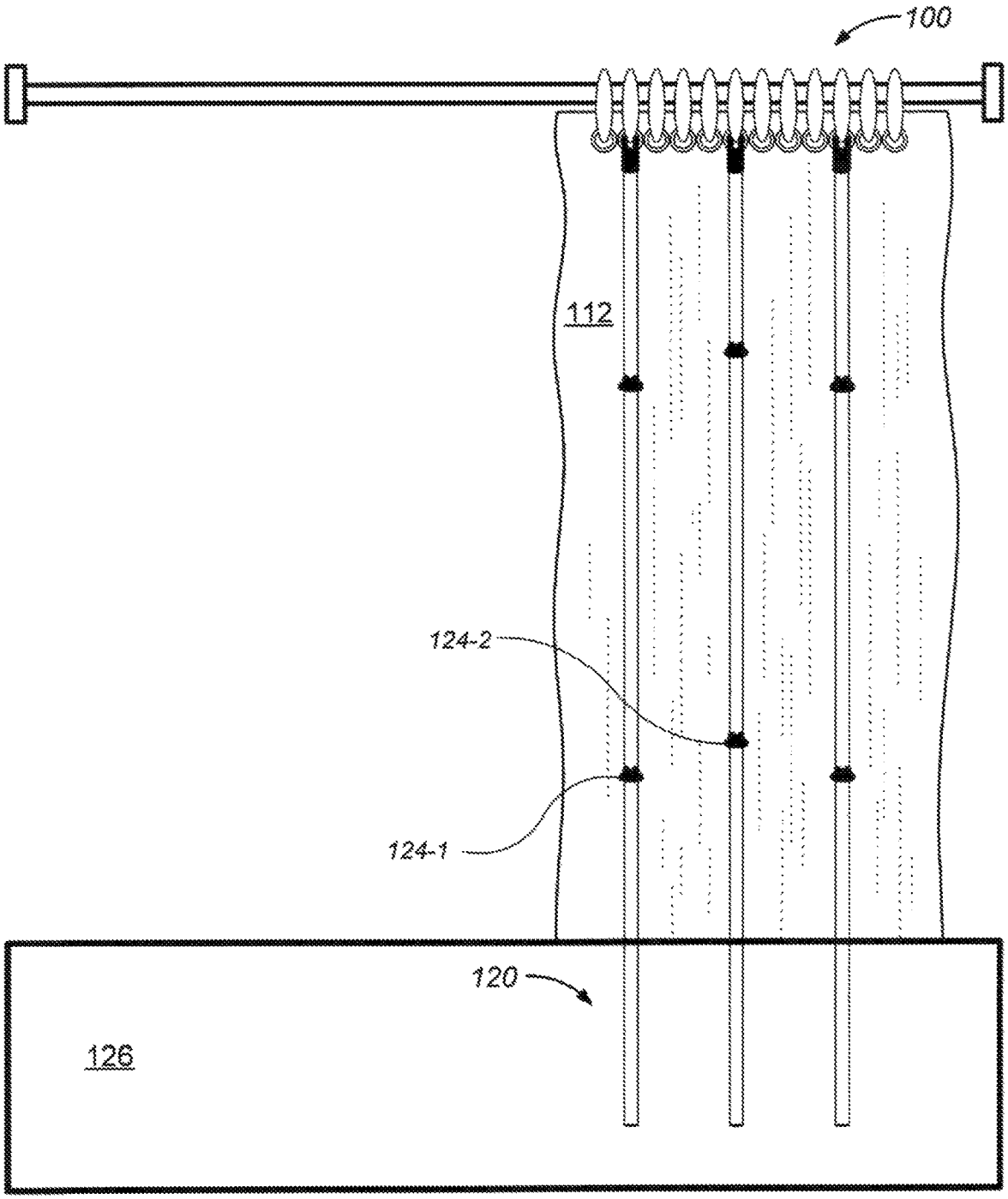
FIG. 1C depicts the embodiment installation of FIG. 1A with respect to a shower equipped bathtub when collapsing the shower liner.
Figure 1D:
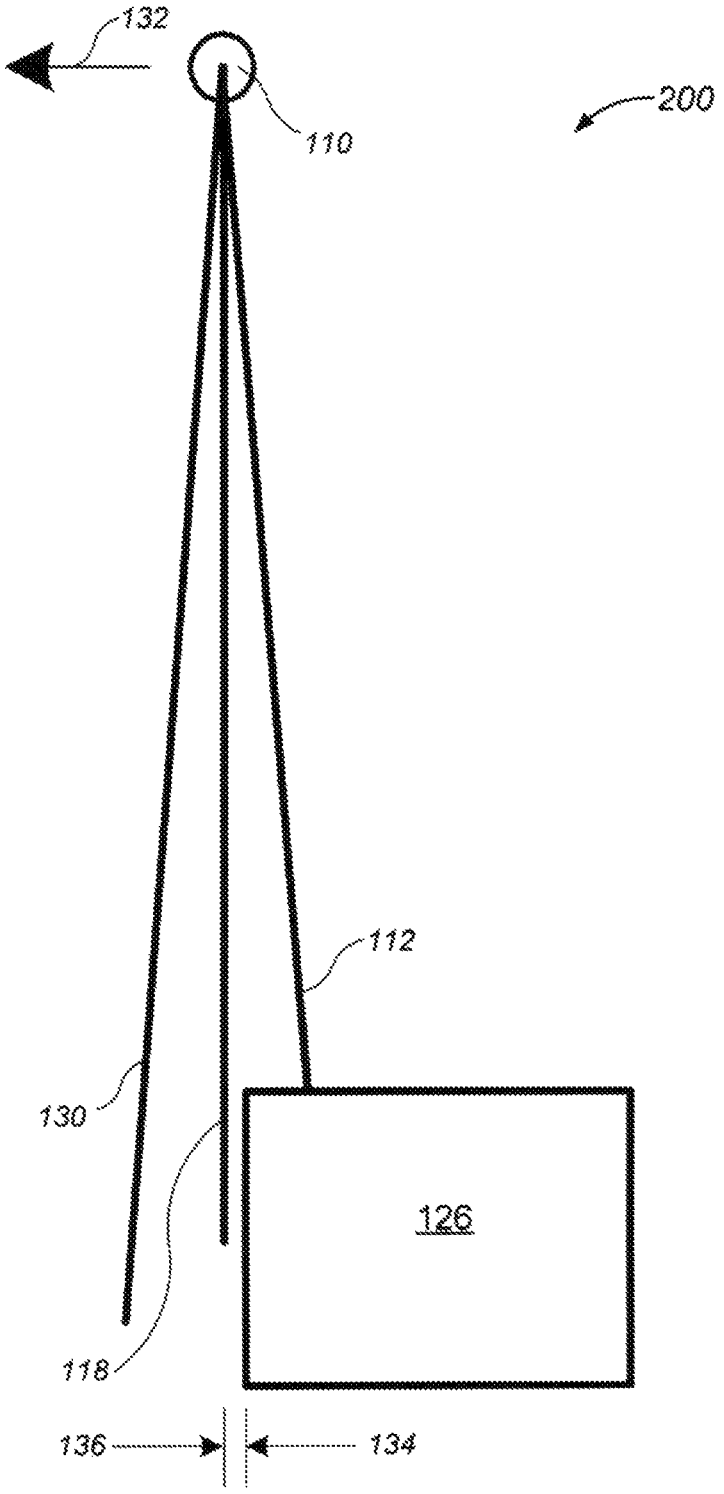
FIG. 1D depicts a side view of the preferred embodiment installation of FIG. 1A with respect to a shower equipped bathtub and decorative shower curtain.
Figure 1E:
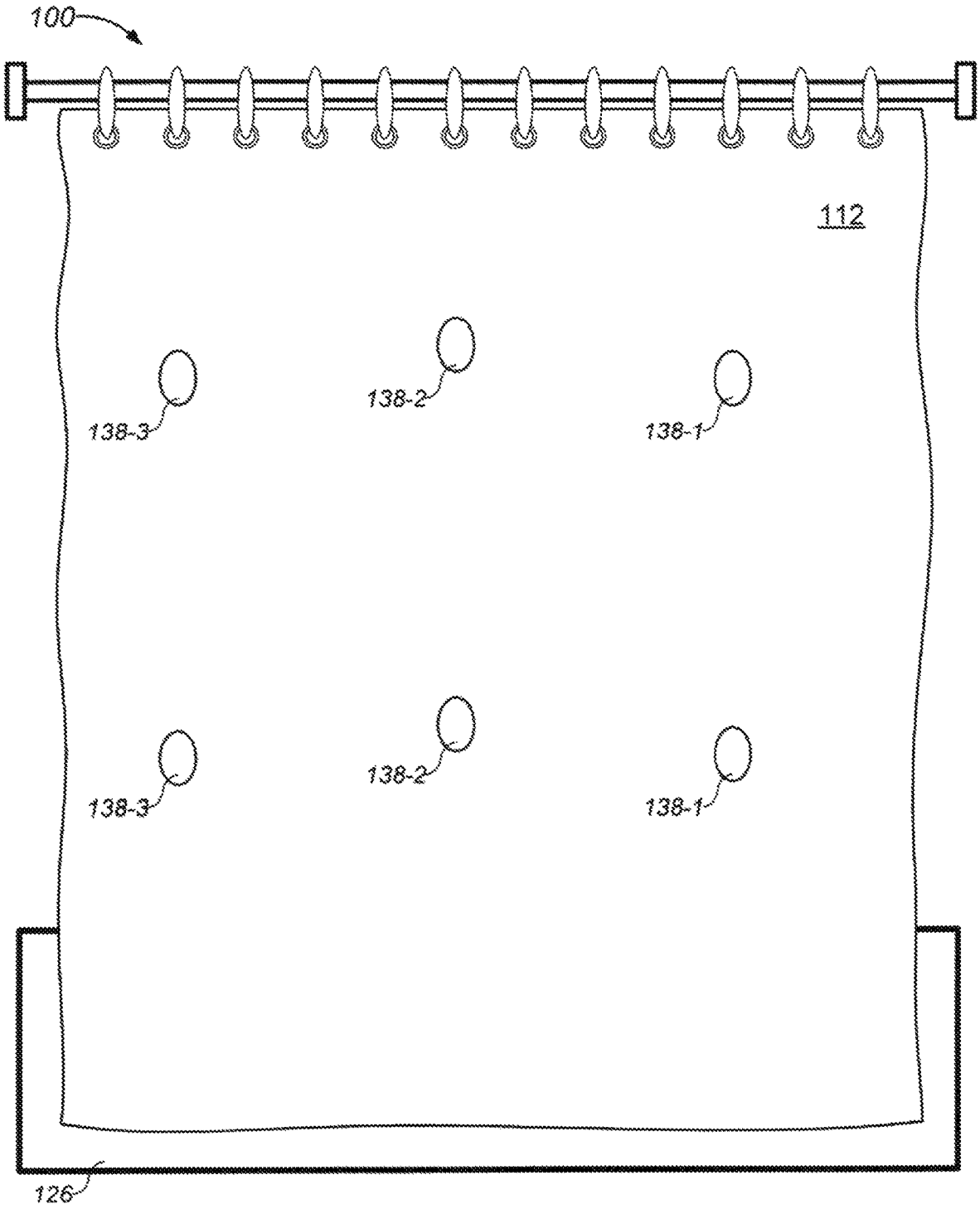
FIG. 1E depicts an in-tub view of the preferred embodiment installation of FIG. 1A with respect to a shower equipped bathtub.

In one preferred embodiment, a shower liner stay support member 118 includes a 4mm diameter fiberglass pensile wand 120 (a vertical fiberglass rod) having a shower liner stay pendent terminator 122 and at least one shower liner stay dry side grasper 124 along with a shower liner stay wet side grasper portion 138 (FIG. 1E). The preferred 4mm vertical fiberglass rod 120 is manufactured with 65-70% glass (or fiber) for maximum rigidity, a suitable resin, and having white pigment for a clean look. Shower liner stay pendent terminator 122 positions support member 118 (and vertical fiberglass rod 120 and engaged components thereof) adjacent the shower liner in an optimal manner, for example by dangling from a hook 114. A preferred embodiment for pendent terminator 122 is a hanging apparatus simply embodied as: a hole at the topmost end of fiberglass pensile wand 120 for engaging a thin diameter plastic loop (e.g. nylon loop) adjusted similarly to a zip tie, for example a small zip tie, a small nylon cable tie, a small nylon snap lock price tag fastener, a beaded zip tie, a snap lock security loop for retail clothing tag securing, a beaded security loop tie, a hang tag nylon string snap and lock, or the like. Testing demonstrates that manufacturing holes at the end of small diameter rods may be error prone, may significantly affect structural integrity, and in most cases is a cost prohibitive post-rod-manufacturing process. While it is preferred for simplicity that pendent terminator 122 be embodied as a hanging apparatus with a hole, another preferred embodiment of pendent terminator 122 is a hanging apparatus depicted in FIG. 1A as: a plastic end cap 122 placed as a terminating sleeve with a compression fit (or alternately glued) to vertical fiberglass rod 120 wherein end cap 122 has an integrated hanging member adequately or adjustably sized. The end cap may also adapt an eyelet at the end of the pensile wand 120 for being engaged with the plastic loop described above wherein the combination of the end cap and plastic loop comprise a hanging apparatus embodiment of pendent terminator 122.

A preferred embodiment of a shower liner stay grasper 124 is a 4 mm ferromagnetic spring steel band low pressure pinch hose clamp that stays tight around fiberglass vertical rod 120 while being adjustably located as desired by decreasing the spring compression of the clamp with finger pinching (or with pliers) force and moving the clamp to the desired vertical fiberglass rod 120 location. The clamps (or clips) preferably surround a majority, if not all, of the vertical fiberglass rod circumference (or perimeter for other pensile wand profile embodiments). Alternately, a shower liner stay grasper 124 is a conveniently finger pinched (or with pliers) single or double wire ferromagnetic spring steel hose clamp designed for 4 mm diameter hoses that can be located anywhere along fiberglass vertical rod 120 and kept tightly in place thereafter. Graspers 124 are ferromagnetic (e.g. metal), for example because they have contents of iron, nickel, and/or cobalt (e.g. alloy).

Dry side shower liner stay graspers 124 of FIG. 1A have a complementary wet side shower liner stay grasper portion 138 (FIG. 1E) to sandwich the shower liner 112. The shower liner 112 will stay adjacently well against support member 118 by holding shower liner 112 in place. Users can adjustably locate grasper(s) 124 as desired before placing grasper portions 138 in place. The embodiment discussed so far for FIG. 1A has grasper portions 138 being magnets. Preferably, magnet embodiments disclosed herein are coated to prevent deterioration or rust, and to enable convenient cleaning, for example a coating of plastic, rubber, epoxy, or other suitable coating to protect the magnet from "the elements". Excellent candidates include Neodymium magnets having a rubber or plastic coating, and having strength of N35 to N52 depending on size and coating thickness. Magnets 138 are preferably white in color for a clean look.

The FIG. 1A example describes graspers 124 having a compression fit. A "compression fit" includes spring action force exerted by a component completely or partially around the profile circumference (or perimeter in some embodiments) of a pensile wand 120. The compression fit may be caused by manipulation of the component (e.g. release squeezing handles of a spring steel clamp (or clip)), or may be caused by a manufactured flexibility in a surrounding component material. The terminology "sleeve" herein refers to a component which surrounds another component while exerting a "hugging" force on the surrounded component because of the material used in the sleeve. Sleeves may be rings, or split rings (e.g. C clips), depending on material. For example, a plastic tube can be a sleeve to a solid rod by the plastic tube having an Inside Diameter (ID) slightly smaller than the Outside Diameter (OD) of the solid rod. The plastic tube can be just flexible enough to be slipped over the end of the solid rod to a desired solid rod location for remaining tightly in place because the plastic tube is strongly flexible for a compression fit without sleeve damage. It is to be understood that "sleeve" is a preferred design, and suitable component designs to attach, affix, fasten, hold, grip, clasp, clutch, hug, or the like, for similar functionality is within the spirit and scope of the disclosure. In some embodiments, a sleeve may glide/slide on a rod (i.e. does not exert a hugging force to a rod) provided there is a suitable engagement to shower liner 112. A sliding sleeve may be a plastic tube having an Inside Diameter (ID) slightly larger than the Outside Diameter (OD) of the solid rod.

With reference now to FIG. 1B, depicted is the embodiment installation of FIG. 1A with respect to a shower equipped bathtub (referred hereinafter as "tub"). Shower liner stay support members 118 preferably dangle outside of the tub 126 while the shower liner 112 is inside tub 126 (liner 112 shown inside tub 126 by direction 128, and FIG. 1B view of tub 126 from outside tub 126). Strong aerodynamic conditions should prevent pulling the reasonably rigid support members 118 into the tub with the shower liner 112. The bottoms of the three support members 118 (shown as members 118-1, 118-2, and 118-3) supported by the outside surface of the tub prevents shower liner 112 from being pulled toward the person taking a shower, even with the lightest physical materials used to make support members 118. The contact between support member(s) 118 and tub 126 outside surface prevents, during aerodynamic conditions, inward movement of shower liner 112 toward the showering area side (i.e. wet side) of shower liner 112. Shower liner stay graspers 124 closest to tub 126 (shown as graspers 124-1, 124-2, and 124-3) should be distant enough away from tub 126 to permit collapsing and opening the shower liner (and shower curtain (not shown)) without much tub 126 friction, yet close enough to prevent swelling of the shower liner 112 at bottommost areas.

With reference now to FIG. 1C, depicted is the embodiment installation of FIG. 1A with respect to a shower equipped bathtub when collapsing the shower liner. Upon collapsing shower liner 112, shower liner stay wet side grasper potions 138 become in closer proximity to each other. In magnet 138 embodiments, this can be a concern because a user does not want magnets to interact with each other, or to interact with other shower liner stay graspers 124. Adjusting locations of shower liner stay graspers ensures no undesirable interactions. Note the different vertical placements of graspers 124-1 and 124-2 so as to avoid undesirable interactions during collapsing shower liner 112. The user can adjust graspers 124 based on neighboring support member 118 interactions as well as aerodynamic conditions.

With reference now to FIG. 1D, depicted is a shower liner stay side view 200 (as viewed from wall not shown that supports curtain rod 110) of the preferred embodiment installation of FIG. 1A with respect to a shower equipped bathtub and decorative shower curtain. Shower liner 112 is positioned inside tub 126 to ensure water stays in tub 126. Shower curtain 130 installed for decorative purposes hangs outside the tub for staying dry. Support members 118 (e.g. having pensile wands 120) dangle between the shower liner 112 and shower curtain 130 at a length to prevent visibility from outside the tub 126, but long enough to support the shower liner 112 using tub 126 as described above. Standard shower curtains and liners are 72 inches tall, so support members 118 preferably dangle by gravity a maximum of about 70 inches from the top of the shower liner 112 which entails a pensile wand 120 about 68 inches long, depending on the pendent terminator 122 embodiment at the pensile wand 120 top, and to accomplish a maximum 70 inches. Such support member 118 lengths are satisfactory in also working properly for taller shower liners and shower curtains as well, for example 78 inch tall versions.

Curtain rod 110 is best positioned a reasonable distance from the tub (i.e. increasing distance between outermost tub wall vertical alignment 134 and vertical alignment 136 describing gravity hanging plumb support member(s) 118, both vertical alignments being perpendicular to floor). Movement of curtain rod in direction 132 enables more room to take a shower in tub 126 and minimizes friction between shower line stay support members 118 and tub 126, including when there are no aerodynamic conditions. Movement in direction 132 should not be so excessive as to cause shower liner 112 from easily leaving tub 126 during a shower. Of course, a curved shower curtain rod 110 may also be used to facilitate more room to take a shower with support members 118 supporting the shower liner 112 using tub 126 as described.

With reference now to FIG. 1E, depicted is an in-tub view of the preferred embodiment installation of FIG. 1A with respect to a shower equipped bathtub. While a person is taking a shower, they may notice the shower liner stay wet side grasper portions 138, depending on their size and color. Continuing with the example above, coated magnets 138 are magnetically attracted to the respectively adjusted shower liner stay graspers on the opposite side (dry side) of shower liner 112. In adult installations, very tiny powerful Neodymium magnets are nearly undetectable except when a swelling shower liner is being controlled during a shower. Larger magnetic objects being used for shower liner stay wet side grasper portions 138 enable child safe embodiments and enable using less shower liner stay graspers 124 because shower liner 112 can be held in place better with a large coupled wet side surface area contact presence upon shower liner 112 occupied by a grasper portion 138.

Figure 2:
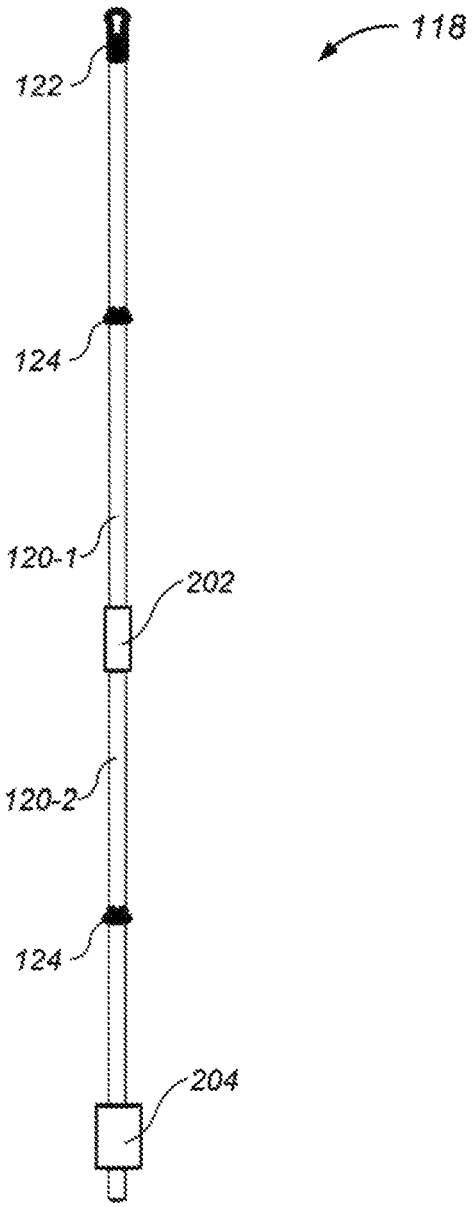
FIG. 2 depicts an alternate embodiment of a shower liner stay support member.

With reference now to FIG. 2, depicted is an alternate embodiment of a shower liner stay support member 118 which is installed to the dry side of shower liner 112. One preferred embodiment discussed includes a 4 mm fiberglass rod 120 about 68 inches long having at least one (e.g. two) adjustably located spring steel clamp/clip (i.e. grasper(s) 124) and a hanging end cap for hanging (i.e. pendent terminator(s) 122). Such a configuration is incredibly lightweight, yet very rigid for controlling a shower liner, and very supportive for coupling to small strong magnets 138. Also, support members 118 may be a single formed component. While 68 inch long rods are no problem for sales of shower liner stay products in major retailers, individual mail orders are complicated by an increase in shipping costs. In a preferred embodiment, at least one shower liner stay wand connector 202 connects a plurality of pensile wands 120, for example pensile wand portions 120-1 and 120-2. Package mailing dimensions less than 3 feet saves significantly on shipping costs. In fact, an even smaller overall mailing package can be accomplished with a plurality of pensile wand portions and a plurality of shower liner stay wand connectors 202 for achieving a total length pensile wand 120 (e.g. vertical rod portions each 4 mm in diameter).

Wand connector(s) 202 may be ferromagnetic (e.g. metal) for eliminating graspers 124. Wand connector 202 may provide attributes of a grasper 124 wherein a wet side grasper portion 138 is coupled to a wand connector 202 (e.g. either magnetic or mechanical coupling embodiments). Furthermore, pensile wand portions may be of different sizes to avoid neighboring wand connectors 202 causing undesirable magnetic coupling interactions as discussed above when collapsing the shower liner, however coupling (e.g. sandwich) locations are limited to wand connector 202 locations. For example, a shower liner stay product may include three different lengths of fiberglass vertical rods 120 (i.e. lengths for 120-1, 120-2 and 120-3) to connect with wand connectors 202 to make a 68" long vertical rod 120, for example: 29 inch, 22 inch, and 17 inch, thereby end to end making 68 inches, but 5" different in lengths to ensure no unnecessary neighboring interactions during shower liner/curtain operation. With the three different lengths included, six different top to bottom pensile wand 120 configurations can be made using wand connectors 202 to ensure no undesirable side by side interactions when collapsing the shower liner/curtain: 29,22,17; 29,17,22; 22,29,17; 22,17,29; 17,29,22; and 17,22,29. The vertical height of wand connectors 202 can be controlled for neighboring pensile wands 120 assembled from pensile wand portions 120 with wand connectors 202, and the wand connectors 202 themselves can be used to accomplish coupling (i.e. no graspers 124 required at all for the shower liner stay because connectors 202 provide double purpose (i.e. connectors 202 may be graspers 124 for grasping shower liner 112, with or without a grasper portion 138 required, depending on the particular grasping embodiment)). Similarly, connectors 202 may provide mechanical coupling embodiments (e.g. integrated snap coupling (e.g. for a grasper portion 138 to couple to the integrated coupling of connector 202)), as well as dry side only coupling embodiments (i.e. no grasper portions 138 wherein connector 202 provides integration of all grasper functionality). For example, connectors 202 themselves may include adhesive functionality described below for one sided (i.e. dry side only) shower liner 112 grasping.

Further adapted to support member 118 may be a shower liner stay padding entity 204 installed at the bottom of support member 118 (e.g. bottom of: a pensile wand 120, or connected pensile wand portions 120). Padding entity 204 is referred to as a spacer 204 or skidder 204, depending on customer focus. Spacer 204 can be used to increase the distance between outermost tub wall vertical alignment 134 and gravity hanging plumb support member 118 vertical alignment 136. Padding entity 204 is a spacer 204 for better positioning the shower liner 112 away from the person taking a shower. Padding entity 204 is a skidder 204 for providing a frictionless touch to tub 126 when opening or closing the shower liner stay installation 100, and to prevent scratching tub 126 depending on material of pensile wand(s) 120. Padding entity 204 can of course provide both features (spacer and skidder). Padding entity 204 is preferably a compression fit sleeve (i.e. tubing) by sliding tightly over pensile wand 120 at the best vertical height for interacting with tub 126. In some embodiments, padding entity 204 is a sufficient length to adjustably add or shorten rigid length to support member 118 for adapting to different heights of shower installations (e.g. for taller showers).

A pensile wand 120 is vertically and perpendicularly positioned relative a curtain rod 110 with a minimally engaged area of shower liner 112, for example minimal vertically aligned and reasonably plumb shower liner 112 surface contact points for the same pensile wand 120. Terminology "pensile wand 120" used throughout this disclosure does not imply a circular or elliptical profile (e.g. for cylindrical fiberglass rod) and is completely generic in material, dimensions, sizes, and attributes. The term "pensile wand 120" used herein refers to a variety of elongated member embodiments accomplishing the identical support member 118 task of positioning components adjacent the shower liner 112 and supporting component features as described for keeping shower liner 112 in spaced apart relation to a shower user, and supporting well placed graspers 124 if applicable (or connectors 202 used for double purpose).

Better cylindrical pensile wands 120 are manufactured of carbon or graphite because those materials are extremely lightweight and very strong candidates for wands 120. However, current market prices are more expensive than fiberglass. Carbon rods and graphite rods may be substantially smaller in diameter than 4 mm which is ideal, provided graspers 124 can be adapted large enough to be effective. For cylindrical pensile wand 120 embodiments (e.g. fiberglass rods), a connector 202 is preferably manufactured as a sleeve formed by a firm plastic tube about 2 to 3 inches in length (may be shorter or longer). Rod portions can be pressed into connector sleeve(s) 202 for forming an overall pensile wand 120. In such embodiments, connector sleeve(s) 202 are preferably translucent for indicating lengths of wands 120 equally inserted therein. Plastics demonstrating good sleeve performance for a connector 202 include Polypropylene, Low Density Polyethylene (LDPE) tubing, High Density Polyethylene (HDPE) tubing, nylon tubing, ABS tubing, PVC tubing, and Polystyrene tubing (e.g. any tubes/tubing herein may have circular profile, oval profile, or suitable profile). In fact, the compression fit is so firm that smaller diameter vertical (e.g. fiberglass) rod portions 120 can be used in place of a longer 4mm fiberglass pensile wand 120. Connector 202 is not limited to any particular material, and any plastic that meets the requirement of coupling rod portions 120 together in a cost effective manner while maintaining shower liner stay support member 118 rigidity may be used. Connector 202 need not be a sleeve. It may be a double sided screw, a dowel, a pin, a shaft, or any other means/method of connecting rod portions together to form a longer length pensile wand 120. Rod ends may be adapted in accordance with the connector 202 type. Cylindrical connectors 202 may also be used to connect pensile wand embodiments which do not have cylindrical profiles, and rectangular profile connectors 202 may be used to connect pensile wand embodiments with cylindrical profiles. Profiles of connectors 202 and profiles of pensile wands 120 may be of any shape and do not have to match to work together effectively.

For fiberglass vertical rod pensile wand 120 embodiments, a padding entity 204 (at bottom end of wand 120) is preferably manufactured as a sleeve formed by a plastic foam tubular product about 2 to 3 inches in length. Plastics demonstrating good padding entity 204 sleeve performance include Polyethylene foam tubing, Polystyrene Foam tubing (i.e. Styrofoam), and other air-infused closed cell or open cell plastic foam cut and/or extruded to a compression fit sleeve (e.g. foam backer rod having small Inside Diameter hole). Padding entity 204 is not to be limited to the mentioned materials. Silicone sponge, rubber sponge, EDPM sponge, low durometer plastics, low durometer rubbers, or the like, for example in tube form, also work well. Any plastic (e.g. tubing), air-infused plastic foam, sponge material, or the like that meets the requirement of a spacer 204 or skidder 204 may be used.

Pensile wands 120 may be manufactured in a variety of materials or plastics. Pensile wands 120, or members 118, in some embodiments may be curved or formed of a particular shape for grasp points being at horizontally spread out shower liner 112 surface areas with a single member 118. Pensile wands 120 may be solid, or hollow tubes. Pensile wands 120 can be of any color and density, although light weight is preferred. Pensile wand 120 material used as good low cost substitutes for fiberglass include hollow HDPE tubes, hollow nylon tubes, solid acrylic rods, hollow nylon tubes, and any reasonable plastic for structure not to significantly bend with a shower liner trying to swell. Pensile wands 120 may be any profile and diameter such as round dowels or tubes, square dowels or tubes, beam profile dowels, angles, or any other profile that can be matched effectively for well operating pendent terminators 122, graspers 124, applicable connectors 202, and applicable padding entities 204.

In some pensile wand 120 embodiments, a rectangular profile polystyrene foam (e.g. 3 lb. Styrofoam) provides super lightweight structure, a minimum cost, and suitable rigidity for many shower liner stay installations, provided other components are similarly well matched (e.g. for desired overall rigidity and dimensions as provided by connectors 202, graspers 124, pendent terminator 122, and/or padding entity 204). Superior foam products usable for pensile wands 120 include polyethylene foams and cross linked polyethylene foams. Pensile wands 120 constructed of such material will have larger dimensions (e.g. diameter, thicker rectangular profile, etc), but will be lighter than fiberglass, wood, or metal rods. Other components are easily attached (e.g. pressed into) such materials.

Pensile wands 120 may simply be a solid 14 gauge wire, or higher gauge (i.e. smaller diameter) ferromagnetic metal wire for the entire length, for example like as used in a low cost dry cleaner wire hanger. In fact, such a wire embodiment only requires manufacturing to cut the wire to length and to bend one end (the top) to a hook configuration for easily making pendent terminator 122 using the wire itself. In magnetic coupling embodiments, using a wire includes a continuous running length of graspers 124 because magnets 138 (i.e. grasper portions 138) can be coupled anywhere along the entire length of wire at the wet side of the shower liner (i.e. graspers 124 integrated to wand 120 itself as being ferromagnetic). As long as collapsing the shower liner is not an issue for magnet interference, this embodiment is acceptable. Padding entities 204 may be required to prevent scratching of tub 126. Poorly treated metal in damp conditions may produce rust over time (therefore coated wire embodiments are preferred), and magnetic interference involves the entire length of the wire when opening and closing the shower liner (therefore smaller magnets are preferred). Weight of wire is also significantly more than fiberglass, carbon, graphite, or light plastic embodiments discussed above.

In some wire embodiments, objects are affixed at strategic points to a rod so as to keep spaced apart relation to neighboring wires in order to avoid magnetic interactions. Such objects may be sleeves for spacing, C clips serving as sleeves for spacing, any of the embodiments disclosed for padding entities 204, or the like.

A pensile wand 120, pensile wand portions 120-1 and 120-2, or a plurality of pensile wand portions for various embodiments need not be constructed of 4mm fiberglass. Any diameter fiberglass and glass percentage recipes apply, as well as any other material meeting reasonably rigid shower liner stay support member 118 requirements of holding back a shower liner 112 without breakage or significant bending. Pensile wands 120 (and other shower liner stay components) may be constructed of any material. There are many options and materials to accomplish manufacturing of shower liner stay support member 118 components. Depending on shower configurations, a showering area architecture edge may be like the outer surface of tub 126 for restricting inward movement of support members 118. Also, support member 118 embodiments may be of sufficient weight to alternatively hang on the dry side of shower liner 112 for dangling on the inside of tub 126 while still supporting shower liner 112 from swelling. In many embodiments, shower liners 112 with magnets in bottom corners, or side gap control methods, may still be useful. Members 118 may be decorative, for example when no shower curtain 130 is used.

A pensile wand 120 may further provide convenient manual operation (opening, spreading, collapsing) of shower liner 112 (and an installed shower curtain 130, for example if installed to an appropriate hook 114, or to curtain rod 110). A support member 118 may also provide additional purpose to facilitate manual operation (e.g. manually operating it, or a handle attached to it, for opening/closing shower liner 112).

Figure 3A:
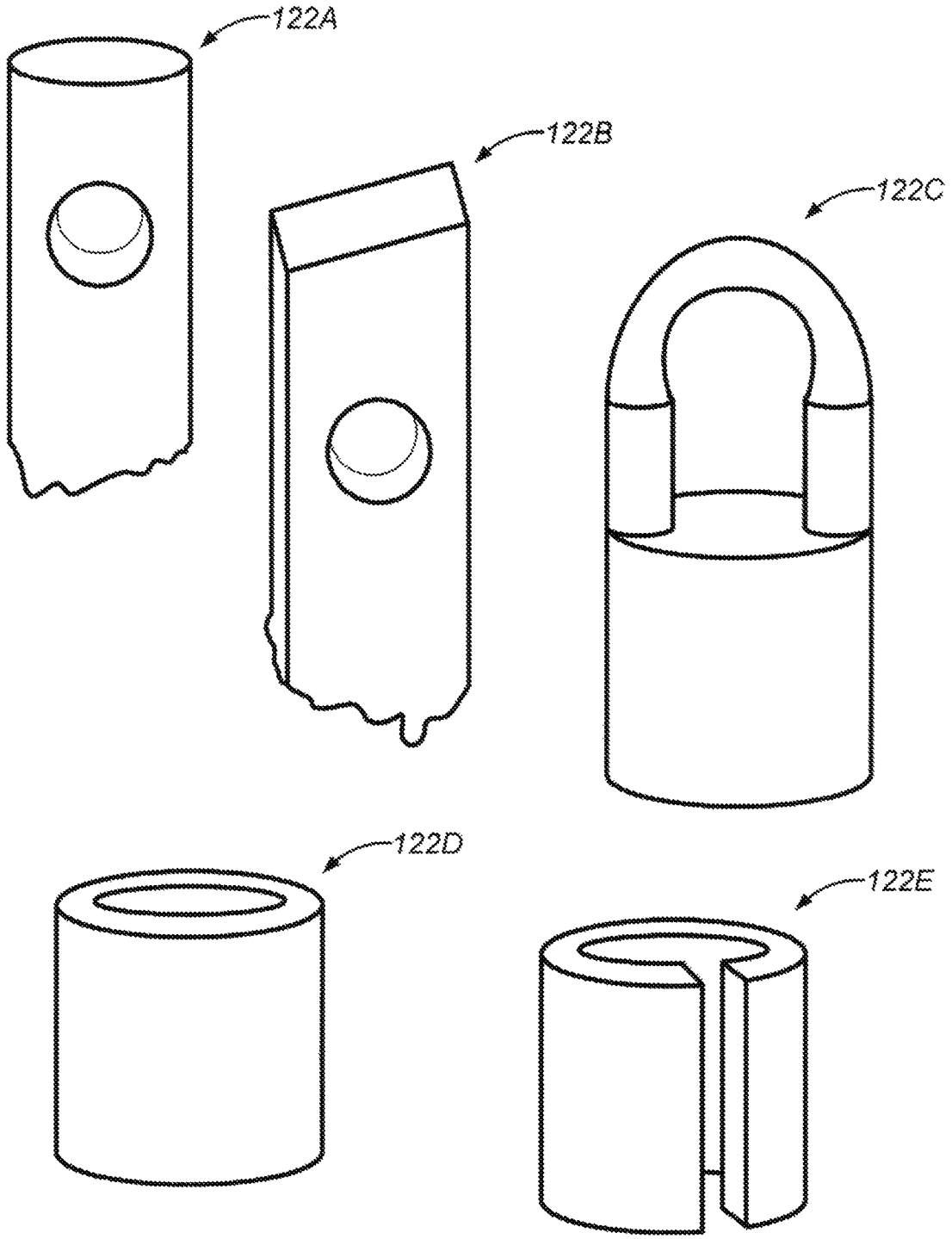
FIGS. 3A and 3B illustrate alternate embodiments of shower liner stay pendent terminators.
Figure 3B:
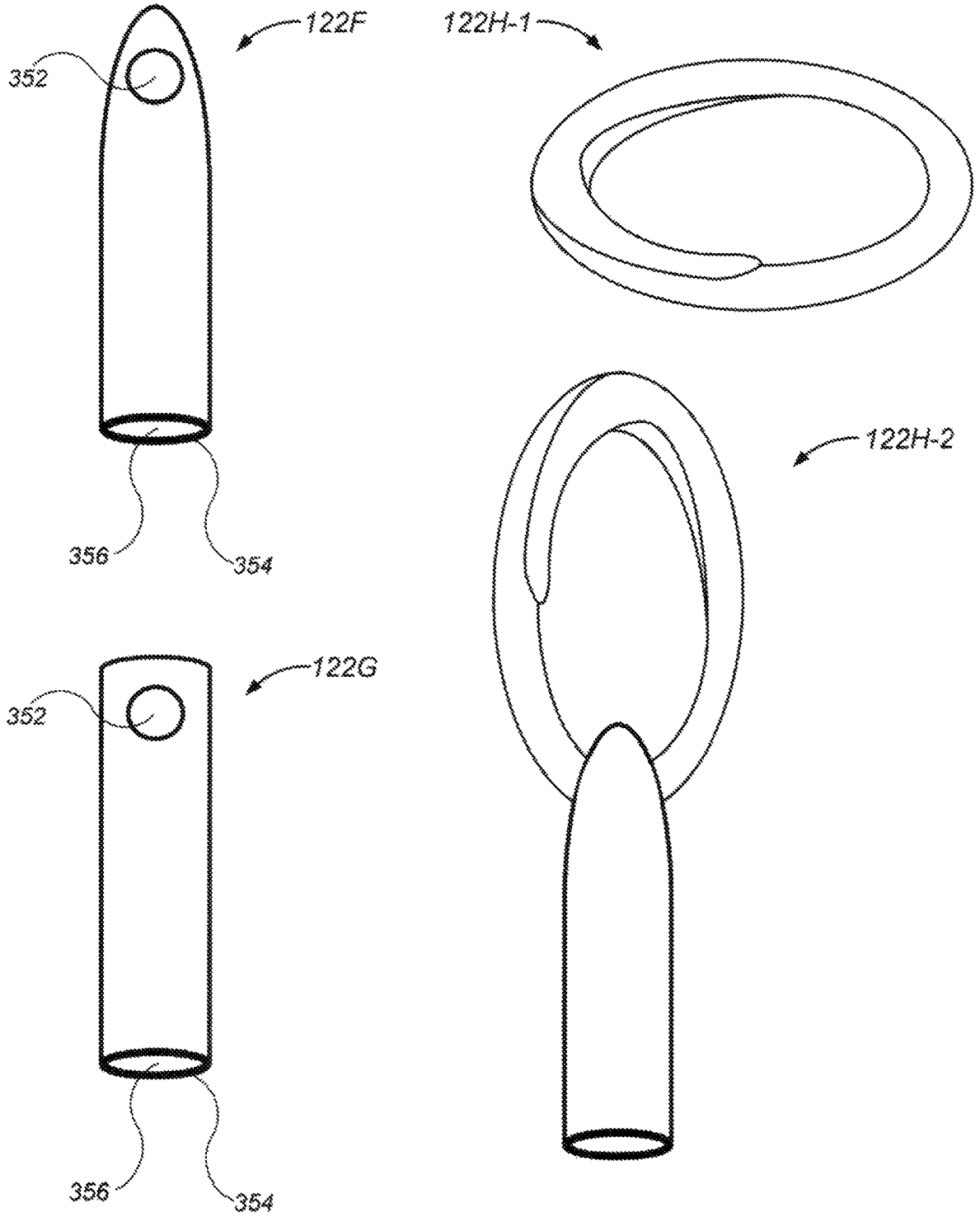

With reference now to FIGS. 3A and 3B, illustrated is alternate embodiments of shower liner stay pendent terminators 122. As discussed above, pensile wand 120 may include a manufactured hole at the top end as illustrated in breakaway top pensile wand 122A wherein a plastic tie (i.e. discussed above) can be used to hang the pensile wand 122A from a hook 114 or curtain rod 110. Alternatively, cord, strap, wire, string, band (e.g. rubber band) or any other material may be used for accomplishing hanging with a loop the pensile wand 120 using the hole in pensile wand 122A. Pendent terminator 122 may be referred to as a hanging apparatus comprised of the hole and hanging material or method used. The hanging material used is preferably adjustable in length to adjust the size of the loop. In another embodiment, a hook or open ended hanger member manufactured of plastic, wire, or suitable material, can be used by inserting one end through the hole of pensile wand 122A and the other end over the hook 114 (or curtain rod 110). A variety of hooks (e.g. well known S hook or C hook, J hook, D hook, G hook, P hook, or any other type of open ended hook) may be used as a hanger of the pensile wand 122A. Further, a split ring (e.g. used for keys and also considered a loop (i.e. see 122H-1)) may be used through the hole to suspend pensile wand 122A. In some embodiments, additional hooks 114 may be installed to specifically dangle support members 118.

Generally speaking, a hanging apparatus for pendent terminator 122 will include a loop or a hook, and in some embodiments a belt. A belt is a strip of material more wide than thick and may be secured by tie, adjusting (e.g. using a particular hole of the belt), or separating weaves to make a hole in the belt to hook 114. As discussed above, rods 120 are not limited to a circular or elliptical profile, for example as illustrated in breakaway top pensile wand 122B having a top hole wherein the hole is used in a similar manner as already described. Pensile wands 120 with a flat surface against tub 126 provide good anti-turn stability, for example for not using a padding entity 204. Pensile wands 120 may have an integrated hanging member (top loop or hook), or may have a hole large enough, to directly engage a hook 114 or curtain rod 110.

Pendent terminator 122C comprises a hanging apparatus embodiment of an end cap for a push-on sleeve for a tight compression fit around the end of a pensile wand 120 with an included eyelet portion suitable for hanging from a hook 114 (e.g. directly, with an engaged loop, with an engaged hook, or the like). To highlight pendent terminator 122, pendent terminator 122C is shown in black in FIGS. 1A, 1B, 1C, 2 and 7A. The eyelet portion (i.e. also consider a hole or loop fashioned to the top of a support member 118) may be made large enough for optionally hanging directly from the curtain rod 110, and the eyelet portion may be a hook or belt, rather than a loop as shown. Pendent terminator 122C can be compression fit to a variety of profiles, and the eyelet portion may be firm or flexible for supporting hanging loops, hooks, belts, or other material for a hanging apparatus. Preferred embodiments of pendent terminator 122C uses plastic (e.g. flexible vinyl end cap (e.g. 122F or 122G), but any other material may be used. Pendent terminator 122C may also be hung like the holes of pendent terminator 122A and pendent terminator 122B because pendent terminator 122C simply adapts a hole at the top of pensile wand 120.

Pendent terminator 122D is a very low cost option push-on sleeve for a tight compression fit around the circumference end of a pensile wand 120. Sleeve 122D pushed onto the top of the rod can be used to securely hold a hook, loop, or belt at the end of pensile wand 120 by inserting a portion of the loop, hook, or belt to the inside of the sleeve before pushing onto pensile wand 120. The compression fit firmly keeps the loop, hook, or belt in place for in turn hanging from a hanger 114 or curtain rod 110. In fact, pendent terminator 122D supports a minimal cost flexible string, wire, plastic (e.g. nylon) string, or strip of material that can be made into a loop by pressing the ends inside the sleeve and pushing the sleeve onto pensile wand 120 for very securely holding both ends before hanging pensile wand 120. Split sleeve 122E (or a C clip 122E) is a split version of sleeve 122D pushed (or clipped if a C clip) onto the top of the pensile wand 120 for identical use like sleeve 122D. Split sleeve 122E may be manufactured of a denser or stronger material with strong spring action, even spring steel, for securely holding a hook, loop, belt, etc. similarly as described for sleeve 122D. Thus, pendent terminator 122 embodiments include fitting an entire circumference (or perimeter in other rod profiles), or partial circumference (or perimeter in other rod profiles) of pensile wands 120. C clips are also well known components suitable for carrying out sleeves 122E, and they come in many dimensions and materials. For example, the slot/gap (i.e. split) of split sleeve 122E will be sized relative the flexibility of a particular material for clipping directly to pensile wand 120 rather than being slipped over an end of pensile wand 120 (i.e. a larger slot/gap will be used for more rigid C clip materials). A C clip 122E may be used on the wet side of shower liner 112 to snap (couple) to pensile wand 120 for sandwiching shower liner 112 (i.e. a snapping male/female component engagement using a C clip grasper portion 138 to: the circumference of pensile wand 120 or an object of pensile wand 120 having a circumference or perimeter).

Pendent terminators 122F and 122G are a compression fit sleeve manufactured of rigid or flexible material with an adapted upper hole 352, a wall thickness 354 for suitable flexibility and/or strength, and an opening 356 to slip over the end of pensile wand 120 (e.g. rod 12) for a compression or glued fit. Such material may be any of the component materials recited above including vinyl, EPDM, silicone, water resistant paper/cardboard/amalgam, or any like material. Depending on embodiments, hole 352 may already be large enough to engage a hook 114 or curtain rod 110. Any of the loop, belt, band, tie, or other embodiments discussed herein for adapting hole 352 for hanging may also be used wherein body 122F or 122G forms a portion of pendent terminator 122. Pendent terminator 122H-2 comprises a body 122F or 122G with a split ring 122H-1 threaded through hole 352 to accommodate the correct size for engaging a hook 114 or curtain rod 110. Split ring 122H-1 may be made of plastic, stainless steel, or any other material. Similarly, split ring 122H-1 may be constructed in a different embodiment for clasping/closing/latching/securing the ring (e.g. a variety of plastic split rings) rather than threading like a keychain. Regardless, an eyelet is provided at the top of pensile wand 120.

In other embodiments, pendent terminator 122 may be a screw eye, or screw hook screwed into the end of pensile wand 120, and may be self tapping. Wire or firm plastic may be pushed into the pensile wand 120 material (e.g. LDPE or HDPE) for adapting a hook, loop, band, belt, or the like. Rivets and grommets may be used to strengthen holes in pensile wands 120. Pensile wands 120 may also be constructed of a material wherein a hook or loop is integrated (formed as single component, or adapted as attached components), or the end of pensile wand 120 may be post manufacturing user manipulated to a desired hanging configuration. Thus, there are many embodiments, flexible or firm.

In another embodiment, pendent terminator 122 may be affixed directly to shower liner 112 with tape, a sticky surface, a double-sided self-sticking pad, Velcro, a suction cup, a magnetic coupling, a mechanical coupling, or by another direct attachment. In such a configuration, pendent terminator 122 components may provide double purpose for additionally service as a grasper (e.g. to a magnet 138). Viewed another way, a grasper 124 can have additional purpose for replacing a pendent terminator 122. In yet another embodiment, pendent terminator 122 hangs from a hole 116, or has an attached fastener (e.g. clip, clasp, clamp, or the like as described herein) for fastening to shower liner 112, shower curtain 130, a hook 114, a hole 116, or something suitable at or near the top of shower liner 112.

There is a large number of embodiments set forth for pendent terminators 122 in hanging a support member 118 without departing from the spirit and scope of this disclosure, some embodiments making use of existing market available products, such as:

- A hole or loop (or eye or eyelet) provided at the top of support member 118, for example by installing thereon a hanging vinyl end cap, hanging rigid end cap, vinyl end cap with hole(s), rigid end cap with hole(s), tubing with hole(s), eyelet end cap, hanger cap, eyebolt (or screw-eye) connected to rod 120 (e.g. with a flexible sleeve (e.g. tubing) engaging eyebolt and rod 120), kite connector end with eyelet (e.g. kite standoff, kite nock, kite standoff holder, kite end cap, JACO/APA standoff holder), cotter pin, rod/strut ends for model automobiles/drones (e.g. tie rod end, strut end/head fitting, sway bar rod end, steering rod end, rod end connector with eyelet, rod end ball joint with eyelet, turnbuckle rod end), end cap with tagging gun installed fastener (V pin, Double pin, Double T end, or the like (e.g. polypropylene or nylon)), a bimini top end cap with eyelet, a boat snubber (e.g. rod through one end loop), a loop ended suspender (e.g. of polyurethane), bungee cord (or like material), or the like;
- A loop (or eye or eyelet) provided at the top of support member 118, for example by installing through a hole or loop (or eye or eyelet) in or at the top of support member 118 a "give-away" split keyring, quality split keyring, elastic cord loop, nylon cord loop, fabric loop, string loop, split ring, clasp, chain or chain link, beaded security loop, cable tie, tag holder, luggage tag loop, luggage worm loop, lanyard (with or without clasp), bracelet or wrist strap, USB lanyard, tagging gun fastener (Closed Ring Hook, V pin, Double pin, Double T end, or the like (e.g. polypropylene or nylon)), fishing tackle leader, hair band, rubber band, plastic spiral ring, jewelry ring, curtain ring, tag snap lock fastener, hang tab, or the like; and
- A hanging apparatus, or portion thereof, provided at the top of support member 118 (engaged through hole, loop, eye, eyelet, or the like; or attached, fastened, glued, taped, melded, welded, secured with securing member, punched, threaded, compression fitted, spring clip fitted, adhered, or the like), for example by installing thereon/therein/through/thereto a retail display hook, tagging gun fastener (e.g. J-hook, Split Ring Hook, Closed Ring Hook, V pin, Double pin, Double T end, Paddle end for insertion through shower liner hole, T end for insertion through liner shower hole, or the like (e.g. polypropylene or nylon)), fastener with or without a tether, clip, clamp, clasp, lobster clasp, wire, suction cup, safety pin (e.g. pear shaped safety pin), adhesive installed eyelet/hook/loop, picture hanger, poster hanger, wall plate hanger, calendar hanger, cloth eyelet or hanger, adhesive hanger eye, clip hanger, Velcro or other hook and loop product, S hook, J hook, hanger, hook, Snap Lock Pin tag fastener, or the like.

Figure 4A:
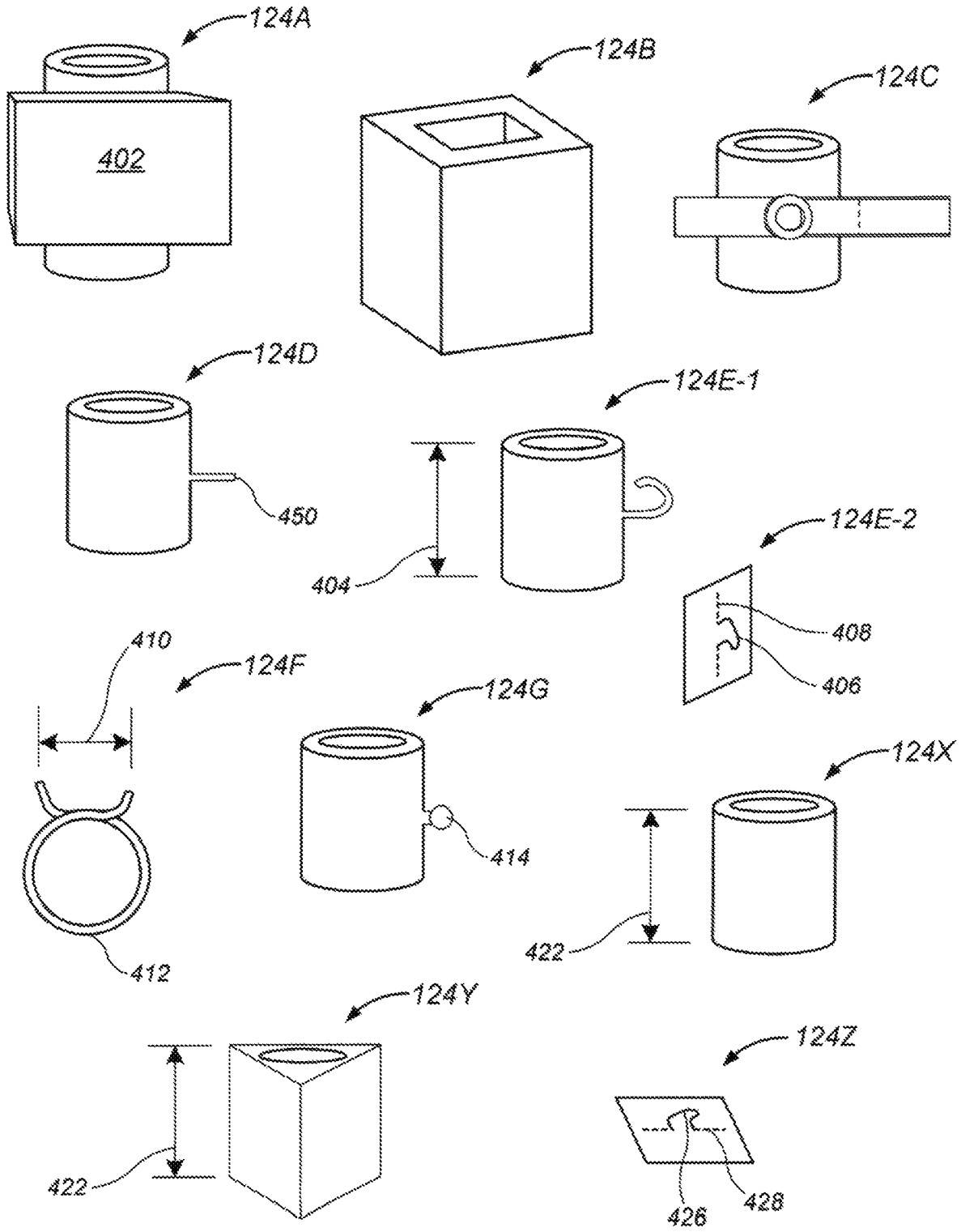
FIG. 4A illustrates alternate embodiments of shower liner stay graspers.

With reference now to FIG. 4A, illustrated is alternate embodiments of shower liner stay graspers 124. A grasper 124 grasps (grabs, clasps, clutches, couples to, sticks to, fastens to, binds with, holds, sandwiches, affixes to, attaches to, hugs, engages, or the like) the lightweight shower liner 112 at the delicate flexible impermeable surface of shower liner 112. No special or altered feature of shower liner 112 to accommodate a grasper 124 is required. Graspers 124 are installed to the dry side of shower liner 112. While components 124A, 124B, 124C, 124D, 124E, 124F and 124G (i.e. graspers 124) show a compression sleeve fit around the entire profile perimeter of pensile wand 120 embodiments, it should be understood that any components 124 may be split rings, C clamps, clips, different shapes/sizes/materials, of different materials, and by any reasonable manufacturing process to accomplish a grasper to a pensile wand 120. Many preferred shower liner stay embodiments do not require wet side grasper portions 138 at all, so that the entire shower liner stay (a system) remains on the dry side of shower liner 112 for maintenance free operation. In some embodiments, graspers are configured like grasper 124A which includes a push-on tight compression fit sleeve to a pensile wand 120. Grasper 124A includes an integrated face 402 (formed as one component 124A, or affixed to the sleeve) for accommodating any of a variety of innovative double sided adhesives or gels such as reusable adhesive putty, "sticky tak" products, poster putty products, reusable sticky gel pads, adhesive gel pads, rewashable and reusable adhesive pads, Stikk gel pads, sticky silicone gel pads, similarly named products, or the like. Also, double or single sided tapes (e.g. from 3M corporation) may be used (preferably they are removable and reusable). Face 402 may take on any dimension or shape for providing a sufficient area to support a double sided adhesive to adhere (i.e. couple, bond, bind, hold, link, fasten to, affix to, stick to, attached to, or the like) to shower liner 112 as described. Grasper 124A may come packaged with the double sided adhesive already applied to face 402 with a removable protective film covering over the side to contact the shower liner 112, or a plurality of double sided adhesive gels, tapes, putties, or the like (described above) will be provided as packaged product components with the shower liner stay product. For shower liners 112 that are disposable, the double sided adhesive may be permanent (or semi-permanent), so replacing with a new shower liner 112 causes using extra adhesive components included in the product package. The sleeve, face 402, and adhesive comprises a shower liner stay grasper 124A wherein no wet side grasper portion 138 is required. In some embodiments, graspers 124 are simply adhesive components (e.g. gel, putty, or tape) applied directly to pensile wands 120 by the user during installation. In some embodiments, graspers 124 provide simply an attachable adhesive side (e.g. gel(s), tape(s) already attached to pensile wand 120), or wand adhesive sections/portions thereof, configured with a protective film covering to be removed at user installation to shower liner 112.

Regardless of grasper 124 embodiments disclosed, shower liner stay installation 100 is similar. For example, grasper(s) 124A are placed onto the rod for an adjustable tight fit (if not already well placed). Exact positions may be adjusted later. Shower liner 112 is spread wide as though a shower is being taken. Support member(s) 118 are secured with pendent terminator(s) 122 for being adjacent the shower liner 112 at the best (per user subjective taste) curtain rod position(s) (e.g. best hook(s) in use by liner 112 at curtain rod position, best dedicated hook(s) at curtain rod position, or best position hanging directly from curtain rod). When support member(s) 118 are comfortably plumb in place with gravity, graspers 124A may be rotated for face 402 to directly face the shower liner 112 to maximize surface contact, and graspers 124A are adjusted to the best vertical height(s). Tests demonstrate that best locations for two component(s) 124A on a single support member 118 are about 2 feet from the shower liner 112 top and about 4 feet from the shower liner 112 top assuming an overall support member 118 of 70 inches in length from the shower liner 112 top. Once adjustments are made and shower liner 112 is hanging comfortably from side to side (end to end length of tub 126), the adhesive can be applied (if not already there) to face 402 and pressed against the shower liner 112, after removing a protective film covering, while carefully avoiding wrinkles. Once all faces 402 are sticking to shower liner 112 via an adhesive as described above, installation is complete. The shower liner/curtain can be collapsed and operated as though no shower liner stay was installed. An unaware user may not notice a shower liner stay installation 100. Grasper 124B may already be shaped with a face 402 for convenient compression fit to pensile wand 120 and a sufficient area to support a double sided adhesive. Note that alternate embodiments of components 124A and 124B support Velcro adhesive as well. Velcro has become so inexpensive that Velcro engagement surface 1 of 2 can be affixed to a face (e.g. 402) for engaging Velcro engagement surface 2 of 2 sticking to the liner with an adhesive backing. The Velcro will continue to operate properly after washing shower liner 112, and extra Velcro engagement surfaces 2 of 2 can be provided for additional new shower liners.

Grasper 124C is integrated with an alligator clip arrangement, preferably for pinching a shower liner 112 in a direction parallel to the bathroom floor. The alligator clip may include rubber, foam, or other soft pinching surfaces for preventing shower liner 112 damage. Positioning/adjusting grasper 124C is best achieved with the alligator clip perpendicular to shower liner 112 when the shower liner 112 is spread out well, and support member 118 is comfortably dangling in a reasonably plumb position. Similar to grasper 124C, a suction cup (not shown) may be integrated to the sleeve (e.g. affixed or formed as one piece) instead of an alligator clip. The suction cup (e.g. silicone or gel) enables coupling to one side of the impermeable surface of shower liner 112. Grasper 124D is integrated with a reasonably sharp stud for poking through a disposable shower liner 112. Positioning/adjusting grasper 124D is best achieved with the stud perpendicular to shower liner 112 when support member 118 is secured comfortably as described above and the shower liner 112 is spread out comfortably. Once poked through the disposable shower liner 112, a complementary cap 138 can be installed as wet side grasper portion 138 for preventing water leakage and for sandwiching shower liner 112. Grasper 124D may include a mushroomed tip, protruding nub, increasing diameter, or other slip prevention feature at or near tip 450 to hold (engage securely in male/female mated position) the cap 138 better in place. Grasper 124E-1 includes an integrated hook for engaging a loop stuck to shower liner 112 with an adhesive (e.g. 124E-2). Such a loop is very inexpensively adapted to shower liner 112 using a reusable or permanent adhesive on the disposable or reusable shower liner 112 dry side as described above (additional adhesive backed loops 124E-2 can be provided in the packaged product for newly replaced shower liners 112). For example, loop 406 may be stitched 408 into a fabric of the adhesive material, or have ends poked through the adhesive material and secured to back with adhesive backing as shown with hidden lines 408. The hook design of grasper 124E-1 may require a sleeve with a minimal length 404 to be most cost effective (so to can components 124C, 124D, 124F and 124G).

Grasper 124F comprises a band style clamp 124 shown as black in FIGS. 1A, 1B, 1C, 2 and 7A, and described above. A profile of grasper 124F is shown because there are various choices including one wire clamp, double wire clamp, band style clamps, and other clamp or clip designs, for example in spring steel. Such clamps (or clips) can be operated by squeezing handles to minimize distance 410 for increasing the clamp (or clip) diameter to install on pensile wand 120, or adjust thereon. Any of the integrated features of FIG. 4A grasper 124 components (clips, adhesives, studs, hooks, sockets, mechanical coupling embodiments, magnetic coupling embodiments, male/female mating component embodiments, or the like) can be adapted or integrated to grasper 124F, preferably at point(s) 412 directly opposite adjustment handles. Grasper 124F in spring steel provides an excellent ferromagnetic grasper 124 for engaging a magnet 138 on the opposite side of a shower liner 112. Grasper 124A, 124B, and graspers similarly designed to 124D and 124E provide excellent ferromagnetic graspers 124 for attracting a magnet 138. A ferromagnetic spring steel C clip, U clip, J clip, E clip, D clip, G clip, or the like may also be used for a grasper 124 to pensile wand 120 wherein the clamping force is similar to FIG 124F in hugging a pensile wand 120, however with the advantage of being pushed (clipped) directly onto pensile wand 120 at the desired location rather than slipped over an end. A non-ferromagnetic clip with attached ferromagnetic material may also be used similarly.

Grasper 124G includes a male snap stud 414 for engaging a female snap socket in a wet side grasper portion 138 for sandwiching liner 112 with a snap engagement. While a typical snap, or stud to socket, embodiment typically used in clothing may suffice, the snap of grasper 124G is delicate to shower liner 112. Grasper 124G is preferably manufactured with appropriate density Polyethylene foam for a firm, yet reasonably soft engagement. The complementary socket 138 is preferably manufactured with the same foam. Of course, other materials may be used to make grasper 124G and complementary socket component 138. Further, roles may be reversed wherein grasper 124 is the socket and component 138 is the stud. Other embodiments of compression fits for components 122 and components 124 are adjustable cords or straps, adjustable belts, tension clips, and the like (e.g. elastic/rubber/plastic bands for securing).

Grasper 124X is a compression fit sleeve to be positioned on pensile wand 120, for example rod 120, wherein a complementary C clip from the shower liner 112 wet side will mechanically engage the circumference of grasper 124X as an alternative to the C clip mechanically engaging the rod 120 circumference itself, for example because rod 120 is manufactured of an incredibly small diameter. Grasper 124X facilitates an easier manufacturing of a C clip with reasonable material choices and grasping tolerances. Similarly, Grasper 124Y is a compression fit sleeve to be positioned on pensile wand 120, for example rod 120, wherein a complementary clip from the shower liner 112 wet side will mechanically engage the architected perimeter of grasper 124Y. Of course, there are other embodiment grasper 124 shapes with architected perimeters to accommodate an appropriate or larger coupling from the wet wide of liner 112 to a very thin rod 120. Length 422 may vary, for example depending on a sought engagement.

Grasper 124Z has a loop 426 (or tie, band, string, belt, or the like—i.e. any of the like eyelet embodiments described herein) with a supporting adhesive strip, nearly identical to 124E-2. Loop 426 may be stitched 428 into a fabric of the adhesive material, or have ends poked through the adhesive material and secured to back with adhesive backing as shown with hidden lines 428. The adhesive may include tape, gel, glue, putty, Velcro, or any of the sticking embodiments described, including above for 124E-2. Grasper 124Z is affixed by a user of liner 112 to the dry side of liner 112. Preferably, there are at least two graspers 124Z installed in a top to bottom vertical path such that a support member 118, pensile wand 120, or rod 120 is passed through the loop 426. For example, graspers 124Z are dry side only graspers attached to liner 112 and the loop engages (encloses) dangling rod 120 to keep the liner 112 away from the showering area. The adhesive may be permanent or facilitate a removable grasper 124Z. Pensile wand 120 slides freely through loop 426 and travels freely as needed through loop 426, for example as small up or down movements occur when liner 112 is opened or closed.

Graspers 124A, 124B, 124C, 124E and 124Z are dry side only (one side of shower liner 112) mechanical grasp embodiments. Graspers 124D, 124F, 124G, 124X and 124Y generally host mechanical engagements (e.g. male to female engagement) to liner 112 wet side grasper portions 138. In alternate embodiments, grasper 124A, 124B, 124C, 124D, 124E, 124F, 124G, 124X and 124Y need not be compression fits to support member 118 or pensile wand 120. The inside diameters, or region of profile space depending on shape, can permit the grasper portion 124 to glide/slide freely (i.e. freely moving fit) over pensile wand 120. Once the liner 112 is grasped, that alone keeps the grasper 124 at the particular liner 112 location on pensile wand 120. Thus, graspers may fit tightly or loosely to pensile wand 120, for example to freely slide as needed in adjustment before invoking a particular grasp to liner 112. This enables liner 112 grasped positions to travel up and down freely as needed, for example as small up or down movements occur when liner 112 is opened or closed. Further, graspers 124 need not surround an entire circumference. A design such as 122E, a C clip, or the like may be used in place of a sleeve to allow installation to pensile wand 120 without having to slip the grasper 124 over an end of the pensile wand 120, but rather to push directly where needed straight onto pensile wand 120.

Graspers 124 coupling to shower liner 112 may include a specific length of material(s) (or joining component(s)), flexible or firm in totality, whereby a specified distance is achieved between support member 118 and shower liner 112 at a grasper 124 location. For example, the sleeve (or other mount to support member 118 which is affixed, attached, coupled to, or the like, to member 118) may include integrated material, component(s) or an attached integration, to maintain a specific distance, or adjustable range of distances, between member 118 and shower liner 112, for example to provide spacing, reduce friction at tub 126, or make shower liner coupling points to shower liner 112 less noticeable. An adjustable length loop, adjustable nylon loop or tie length (as described herein), cord/strap with adjustment member (e.g. spring loaded cord lock), ratcheted zip tie arrangement of any material, or the like, may be used. In some distance maintaining arrangements, a wet side grasper portion 138 slip prevention feature (e.g. adjustably located slip prevention collar) may be included on the dry side of shower liner 112 for preventing slippage of a grasper portion 138 from shower liner 112 toward the showering area.

There is a large number of embodiments set forth for graspers 124 without departing from the spirit and scope of this disclosure, some embodiments making use of existing market available products, such as:

Magnet(s) on the shower liner 112 wet side for coupling or sandwiching shower liner 112, for example by installing to support member 118 a ferromagnetic coupler: clip, C clip, U clip, J clip, E clip, D clip, G clip, clamp, binder clip, clam clip, open Terry Tool clip, closed Terry Tool clip, tool clip, peg-board clip, Gripper clip, Grip Clip, spring clip/clamp, spring, collar, cord stopper/toggle, hose clip/clamp, tube clip/clamp, rod clip/clamp, pipe clip/clamp, leaf spring, band spring, tarp clip, greenhouse fabric clip, fuel or vacuum hose clip/clamp, cable clip, wire clip, metal tape, shaft collar, split seam sleeve/spacer, tension pin, metal reinforced edge trim or edge guard piece, bushing, spacer, ear cuff jewelry, nose ring jewelry, split ring, jump ring, ring (e.g. clip/clamp/sleeve supported), stringing bead (barrel, sphere, or any suitable shape; perhaps with internal silicone/rubber O-ring or gasket to hug pensile wand 120), bore reducer, bore sleeve, hollow rivet, nut, washer, shaft sleeve, axle sleeve, spring/dowel pin, rollpin, ferromagnetic stretch band, metal installed rubber or elastic band, split sleeve, split tension pin, split seam spacer/tube, set screw collar, banner clip, cotter pin, split collar, standoff, clip/clamp/sleeve supported or affixed ferromagnetic material, another magnet, clip/clamp/sleeve supported magnet, wire, attached metal, an affixed (or supported) decorative or material body having included a suitable ferromagnetic metal therein, an affixed (or supported) ferromagnetic metal impregnated plastic or other material, or the like;

Magnet(s) on the shower liner 112 wet side for coupling or sandwiching shower liner 112, for example by installing to support member 118 a non-ferromagnetic version of each coupler (perhaps with self-adhesive for attaching a ferromagnetic piece) in the previous paragraph with an integrated or affixed (i.e. attached, adhered, glued, welded, fastened, taped, melded, welded, secured, fitted, or the like) ferromagnetic piece or portion, or the like;

Magnet(s) installed to support member 118 on the shower liner 112 dry side for coupling or sandwiching shower liner 112 for a visa-versa (i.e. mirror image) configuration to the previous two paragraphs wherein a ferromagnetic coupler (e.g. to ferromagnetic metal preferably coated or plated in a waterproof or water-resistant material, an affixed decorative or material body having included a suitable ferromagnetic metal therein, an affixed ferromagnetic metal impregnated/integrated plastic or other material, or the like) is installed to the wet side of shower liner 112 for sandwiching shower liner 112, for example by affixing the magnet(s) to support member 118 by: 1) any of the coupler varieties above (i.e. ferromagnetic quality not required (e.g. self-adhesive to attach magnet)); 2) attached, fastened, affixed, glued, taped, melded, welded, secured with securing member, compression fitted, adhered, or the like directly to support member 118; 3) integrated into support member 118 (e.g. manufactured into pensile wand 120); 4) attached, fastened, affixed, glued, taped, melded, welded, secured with securing member, compression fitted, adhered, or the like to a component which in turn is attached/affixed to support member 118 (e.g. adhesive backed magnet adhered to suction cup with C clip to pensile wand 120), hole in the magnet matching circumference of pensile wand 120 (and perhaps supported by a full or split sleeve, clip, collar, internal silicone/rubber O-ring or gasket to hug pensile wand, or the like), a magnet manufactured in an appropriate form (e.g. clip, clamp, etc as described herein), a plurality of attracting magnets hugging support member 118 (e.g. pair of arc/curved shaped magnets adjacent pensile wand 120 circumference), or the like;

Magnet(s) on the shower liner 112 wet side for coupling or sandwiching shower liner 112, for example by installing to support member 118 other magnet(s) or magnetized couplers (many embodiments above), or the like;

Non-magnetic grasper portion installed to the wet side of shower liner 112 for coupling or sandwiching shower liner 112, for example by snapping/engaging/coupling (preferably a water resistant/waterproof component) to an attachment of support member 118 with a clip, clamp, C clip, U clip, snap object, male or female engaged object, film clip/clamp, circumference clip/clamp, edge trim or edge guard piece, split (slot/gap) piece of tubing, or the like;

Non-magnetic grasper portion installed to the wet side of shower liner 112 for coupling or sandwiching shower liner 112, for example by snapping/engaging/coupling to an integration of support member 118 being a snap target, circumference for a coupler (clip, clamp, split (slot/gap) piece of tubing, film clip/clamp, circumference clip/clamp, edge trim or edge guard piece, or the like), male or female coupling target, or the like; and Non-magnetic grasper 124 installed to only the dry side of shower liner 112 for grasping shower liner 112, for example using Velcro (e.g. support member 118 Velcro 1 of 2 and shower liner 112 Velcro 2 of 2), adhesive, tape, double sided adhesive material, clip, clamp, suction cup, clasp, static electricity attractor, adhesive applied loop, adhesive applied to liner 112 that has member to attach/affix/couple/grab/engage/etc to pensile wand 120 (C clip, hook, clasp, or the like), or the like.

There are grasper 124 embodiments wherein no support members 118 are required. Graspers 124 (and complementary wet side grasper portions 138 if applicable) are the only components required for a complete shower liner stay product and system when a heavy enough decorative shower curtain 130 is present. For example, graspers 124 can be on the dry side only of shower liner 112 (similarly to 124A, 124B, 124C, 124E and 124Z) while making use of shower curtain 130 for support to keep shower line 112 away from the showering area (i.e. no support members 118 required). Adhesive backed loop 124E-2 may be placed at one or more appropriate points (i.e. places/locations) on the surface of the dry side of shower liner 112, and an appropriately sized hook (e.g. well known S hook or C hook, J hook, D hook, G hook, P hook, or any other type of open ended hook, and of any material or plastic) can replace the 124E-1 integrated hook for being directly threaded through shower curtain 130 (e.g. weave of fabric) for in turn attaching to adhesive backed loop 124E-2. The hook may be small enough to be unnoticeable from the outside view toward shower curtain 130. The hook retains shower curtain 130 in close relation to shower liner 112 for shower curtain 130 being used to support shower liner 112. The hook may be of an optimal size, or have an overall length by design or adaptation, to maintain an optimal distance of vertical alignment 134 to vertical alignment 136 (i.e. for maintaining a specified spaced apart relation) wherein vertical alignment 136 is representative of the shower curtain 130 being used for support, rather than a support member 118 as illustrated in FIG. 1D. Similarly, adhesive backed loop 124Z engages with a pin, shaft, or object secured to shower curtain 130 for retaining liner 112 to away from the showering area. Preferably, grasper 124 installation points upon shower curtain 130 (to shower liner 112) is not too close to tub 126 as to cause excessive friction when opening or collapsing the shower liner and curtain. Also, such points of shower curtain 130 (to shower liner 112) can be minimal and spread out in a similar member 118 manner without negatively impacting the decorative purpose of shower curtain 130. In some embodiments, shower liner 112 is manufactured in anticipation of graspers 124 (rather than user manually installing) using shower curtain 130 for support. For example, loops, hooks, Velcro, or other like attachment points are integrated to, and provided by, shower liner 112 for grasper 124 attachment/coupling thereto. Similarly, shower curtain 130 may have integrated grasper portions for attaching to a shower liner 112 (e.g. attach loop/hook integrated/manufactured on shower curtain 130 with loop/hook integrated/manufactured on shower liner 112—simply connect matching loops/hooks (e.g. using hook, wire, loop, bond, binder, link, or any other coupling)). In a similar grasper 124 embodiment, a loop (e.g. plastic) can be used as described above (i.e. thin diameter plastic loop (e.g. nylon loop) adjusted similarly to a zip tie, for example a small zip tie, a small nylon cable tie, a small nylon snap lock price tag fastener (i.e. a variety of tagging gun fastener as described above), a beaded zip tie, a snap lock security loop for retail clothing tag securing, a beaded security loop tie, a hang tag nylon string snap and lock, or the like) for being threaded (or poked) through shower curtain 130 and adhesive backed loop 124E-2 before closing the loop, and perhaps adjusting it. Thus, cords, straps, belts, strings, wires, plastic ties, bands, or the like (some adjustable for adjusting closeness of shower curtain 130 to shower liner 112) can be similarly threaded (or poked) through shower curtain 130 material (e.g. fabric) to use shower curtain 130 as a support member for retaining shower liner 112 with a grasper 124 on only the dry side of shower liner 112. In some embodiments, the hook or loop of grasper 124 is so small (e.g. diameter of a pin, or a nylon clothing price tag fastener), it can be threaded through a weave of shower curtain 130 without any presence viewable at all from the outside view (of shower curtain 130). In some embodiments, a decorative intentional visible presence (e.g. decorative head) of grasper 124 is seen on the outside of shower curtain 130.

An integrated hook or loop 124E-1 design variation may be manufactured for an intentional presence on the outside view of shower curtain 130 (i.e. decorative head), for example for decorative purposes, or for ensuring shower curtain 130 retains shower liner 112 away from the showering area by preventing grasper 124 from being pulled through, or out of place from, shower curtain 130. A decorative object or body 124E-1 (rather than the sleeve shown) can include a hook, loop, or the like (may be adjustable) to press through shower curtain 130 at an appropriate point (i.e. location/place) for being engaged (coupled) to adhesive backed loop 124E-2. The decorative object or body retains shower curtain 130 to shower liner 112 so that shower curtain 130 acts as a support member when providing placed objects on the outside of the shower curtain 130 (meeting child safe requirements if necessary). Depending on a distance to maintain between (may be adjustable, or flexibly arranged) shower curtain 130 and shower liner 112, a slip prevention feature (e.g. adjustable collar) may be included to a grasper 124 adjacent, or at, the inside of shower curtain 130 to prevent the object or body (may be referred to as the head of the grasper 124) slipping away from shower curtain 130 outside shower curtain 130.

There is a large number of embodiments set forth for graspers 124 using the shower curtain 130 for support rather than a support member 118 without departing from the spirit and scope of this disclosure, some embodiments making use of existing market available products for attachment to or through shower curtain 130 and in turn incorporating any of the grasper embodiments discussed herein, such as: a tie clip, lapel pin, safety pin, wire, headed pin, tagging gun installed fastener as described above (e.g. polypropylene or nylon), decorative body with pin/wire/shaft/fiber/plastic-poker/etc, matching Velcro portion (coins, pads, etc), double sided sticky tape/coin/pad, adhesive, tape, clip, clamp, hook, clasp, fabric attachment, iron-on attachment, curtain hook, thread wire, threaded string/belt/cord/etc, boat snubber, loop ended suspender (e.g. of polyurethane), bungee cord (or like material), coupler for sandwiching of shower liner 130 (e.g. magnetic coupling, or non-magnetic coupling, see embodiments above including directly to shower liner 112), fastener for engaging shower liner 112 integrated attachment means, fastener for engaging shower curtain 130 integrated attachment means, incorporating any applicable fastener or characteristic of graspers already disclosed for grasping shower curtain 130 or shower liner 112, or the like.

Figure 4B:
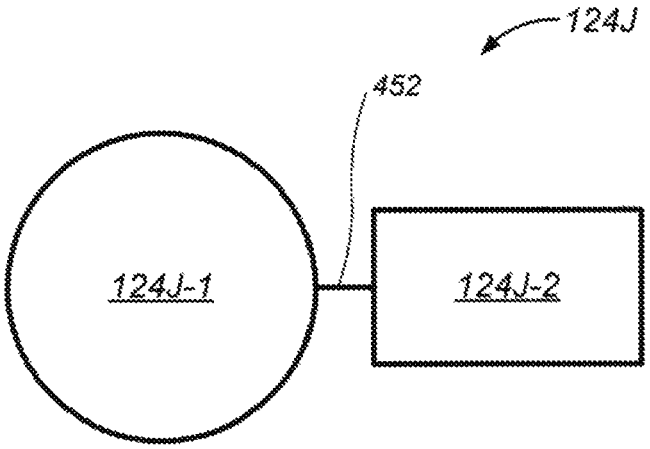
FIG. 4B illustrates alternate embodiments of shower liner stay graspers when using a shower curtain as a support member.
Figure 4B:
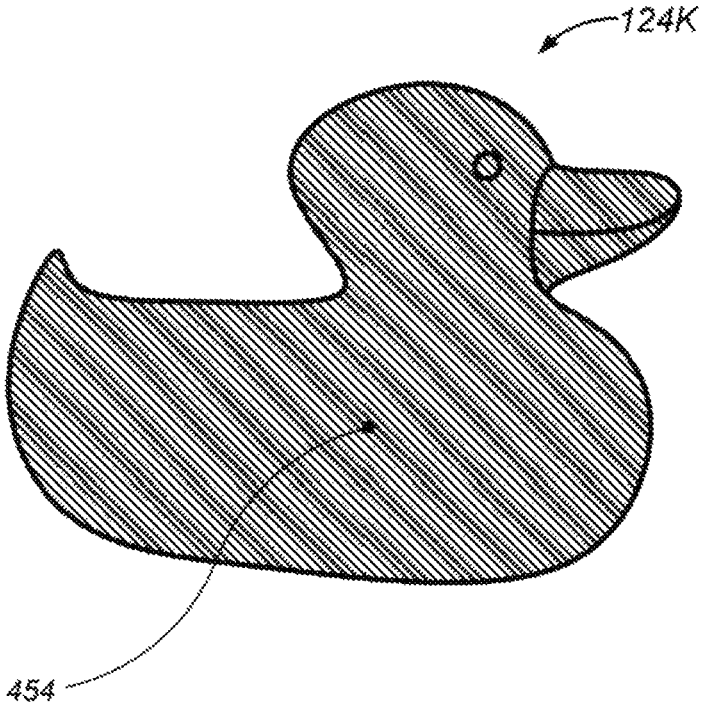

With reference now to FIG. 4B, illustrated is alternate embodiments of shower liner stay graspers when using a shower curtain 130 as a support member. Graspers 124J can be viewed in light of requiring no support members 118 by understanding grasper to configurations. A FIG. 4A grasper 124 includes an object (referred to as a body) 124J-1 to leverage the support of a support member 118 (e.g. by a sleeve, by a compression fit, or by other attached/affixed embodiment) with an integration 452 to a grasp feature 124J-2 to perform grasping (integrated as one formed component, or attached). For example, the sleeves of graspers 124A, 124B, 124C, 124D, 124E, 124G, 124X and 124Y comprise objects 124J-1 (referred to as bodies) and the compression fitting ring of grasper 124F comprises the 124J-1 body. A "body" referred to in this grasper 124 context, is an object of a particular material with suitable dimensions, and of any appearance, colors, shapes, etc. as appropriate for being adjacently held against shower curtain 130 in a stable engaged (coupled) position at desired point(s). Grasper 124A integrated face 402 with adhesive is the grasp feature 124J-2. Grasper 124B integrated face with adhesive is the grasp feature 124J-2. The grasper 124C integrated alligator clip is the grasp feature 124J-2. The grasper 124D integrated poking tip 450 is the grasp feature 124J-2. The grasper 124E-1 integrated hook with adhesive component 124E-2 is the grasp feature 124J-2. The grasper 124F ferromagnetic quality (for attracting a magnet) is the grasp feature 124J-2. The grasper 124G male stud 414 (for attracting a female engagement) is the grasp feature 124J-2. The grasper 124X circumference (for engaging a C-clip) is the grasp feature 124J-2. The grasper 124Y architected perimeter (for engaging a clip) is the grasp feature 124J-2. Similarly, grasper 124 embodiments disclosed herein have a grasper feature 124J-2.

Thus, when using shower curtain 130 for support, graspers 124J include a shower curtain attachment member 124J-1 with integration 452 to a shower liner attachment member 124J-2. As described above, some graspers 124J may be viewed, or may be hidden, from the outside view of shower curtain 130. Thus, shower curtain attachment grasper member 124J-1 may comprise: a body/head on the outside view of shower curtain 130, a small body/head (e.g. threaded through shower curtain 130) for not being viewed, or an attachment body/head regardless of style, to shower curtain 130 (seen or unseen). Grasper member 124J-1 may further be retained adjacent shower curtain 130 with a slip prevention feature (e.g. adjustable collar at inside of shower curtain 130, or the like). Shower liner attachment grasper member 124J-2 will provide an appropriate grasp feature for grasping shower liner 112. For example, shower liner attachment grasper 124A member 124J-2 may be integrated (452) through use of snap (see 414), tip 450, female to male connection (or visa versa), a hook, a loop, a string, a cord or strap, a belt, a wire, a pin, or the like (and may be adjustable length), so face 402 is on the shower liner 112 side of shower curtain 130 when connected to member 124J-1. Similarly, shower liner attachment grasper 124B member 124J-2 may be similarly integrated (452) so a face is on the shower liner 112 side of shower curtain 130. Similarly, shower liner attachment grasper 124C member 124J-2 may be similarly integrated (452) so the alligator clip is on the shower liner 112 side of shower curtain 130. Similarly, shower liner attachment grasper 124D member 124J-2 can simply be poked through shower curtain 130 (preferably without damage to curtain 130), and in turn shower liner 112 (or alternatively tip 450 is an integration 452 (perhaps flexible or adjustable length) for being attached to a grasper member 124J-2 for grasping shower liner 112). Shower liner attachment grasper 124E-1 member 124J-2 may also simply be poked through shower curtain 130 (or alternatively the hook is integration 452 for being attached to a grasper member 124J-2 for grasping shower liner 112). Shower liner attachment grasper 124F member 124J-2 can be matched to a magnet 138 on the wet side of shower liner 112, or can be matched to another dry side shower liner attachment grasper member 124J-2 used in turn to grasp shower liner 112 via grasper portion 138 (e.g. magnetically). The shower liner and shower curtain may be clipped together using graspers 124X or 124Y, or a dry side clip to shower curtain 130 hosts another grasper feature to the shower liner 112.

There are many embodiments of an integration 452 with respect to shower curtain 130 for providing an appropriate grasper 124. Integration 452 and 454 provide a connectivity, a coupling, an attachment, an affixing, a bridge, a join, a connector, a linkage, a bind, a bond, or the like, with or without an adjustable length, with or without slip prevention features for shower curtain 130 or shower liner 112 (e.g. adjustably located collars opposite side), and firmly or flexibly for distancing apart shower curtain 130 and shower liner 112. Integration 452 and 454 may comprise a single part (or component, member, or the like), or a plurality of parts (or components, members, or the like) for coupling grasper member 124J-1 to grasper member 124J-2. For example, a flexible coupling between shower liner 112 and shower curtain 130 maintains a maximum distance, but a firm coupling between shower liner 112 and shower curtain 130 may maintain both a minimum and maximum distance.

Grasper 124K is a decorative body (member 124J-1) without one of the many alternate embodiment grasp features (member 124J-2) shown (backside of body 124J-1 is to shown (i.e. surface of body in contact with shower curtain 130)). Grasper 124K is installed to shower curtain 130 for in turn grasping a shower liner 112 using shower curtain 130 for support (i.e. no support members 118). Grasper 124K body 124J-1 may include a slip preventing adjustable collar at the inside of shower curtain 130. Integration 454 (like 452) to a grasp member 124J-2 is used. The integration 454, or member 124J-2 itself, may maintain a desired distance between coupling point(s) of shower liner 112 and shower curtain 130. In other grasper 124 embodiments, at least a minimum body 124J-1, adjacent shower curtain 130 for using shower curtain 130 as support, is joined to, attached to, coupled to, affixed to, poked through or hosting a poke through, positioned at a supporting point in shower curtain 130, clipped to, clamped to, or the like, shower curtain 130. Body 124J-1 can be attached to a flexible hook, loop, belt, or the like (an integration 452) to a grasper feature (member 124J-2) for grasping shower liner 112 (with or without grasper portions 138 as applicable). Body 124J-1 can be attached to a firm pin, nail, fiber, shaft, rod, tack, staple, or other attachment means (may be flexible), or the like (e.g. an integration 454) to a grasper feature 124J-2 for grasping shower liner 112 (with or without grasper portions 138 as applicable). Body 124J-1 can be coupled to shower liner 112 using a grasper feature 124J-2 through shower curtain 130 (with or without grasper portions 138 as applicable). Grasper portions 138 still apply to graspers 124 wherein shower curtain 130 is used for support.

When no support members 118 are required, the preferred shower liner stay product consists of a barcode marked package containing installation instructions, advertisement collateral (e.g. packaging header with title "Shower Liner Stay" and advertisement picture facilitating immediate product understanding), and the following shower liner stay components: one or more shower liner stay graspers and any applicable shower liner stay grasper portions, and any other applicable components (i.e. parts (e.g. adhesives, wires, hooks, loops, connections, pins, strings, etc), pieces, integration parts or components, or the like).

Figure 5A:
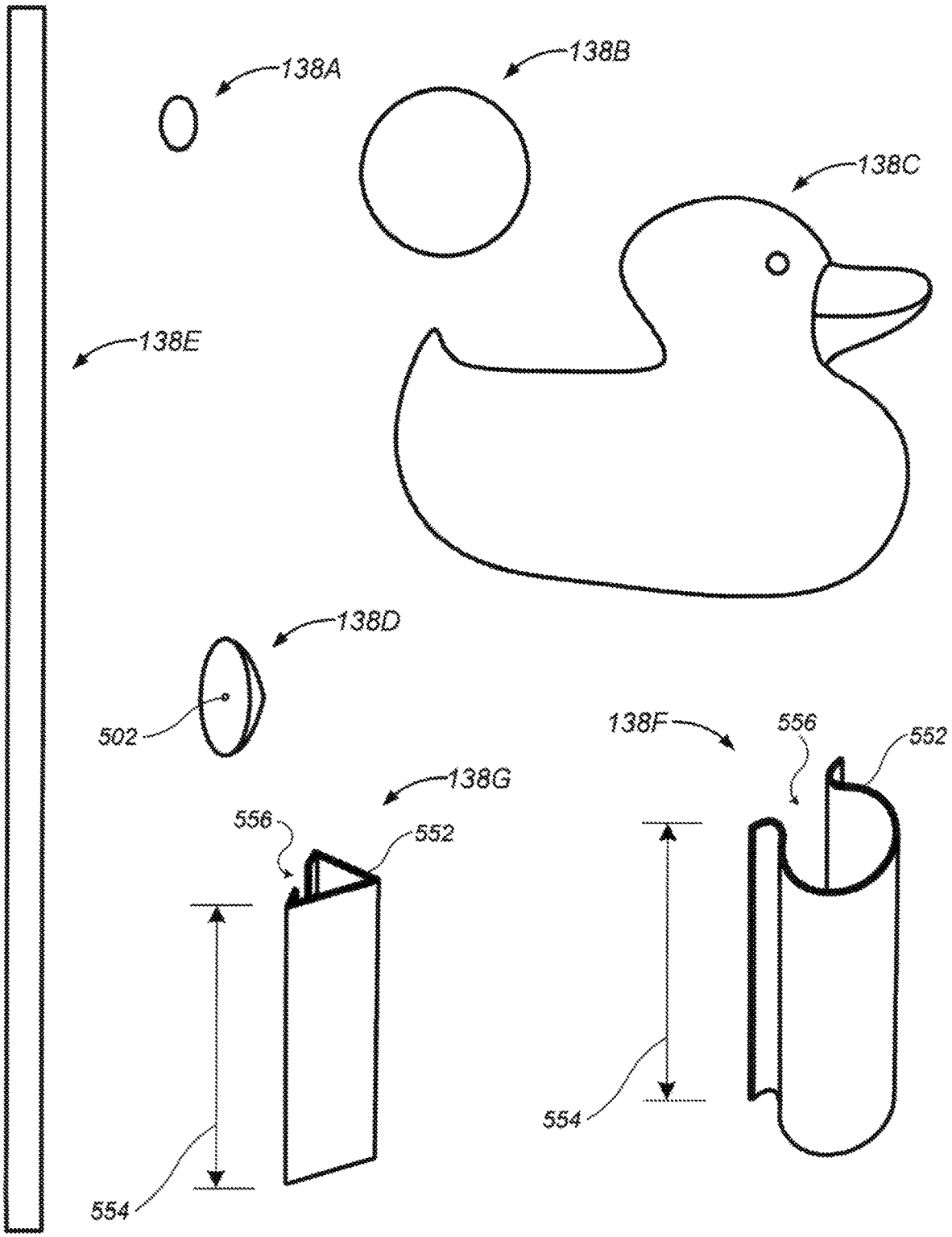
FIGS. 5A and 5B illustrate alternate embodiments of shower liner stay grasper portions.

With reference now to FIG. 5A, illustrated is alternate embodiments of shower liner stay grasper portions 138. A wet side grasper portion 138 couples (i.e. fastens to, binds with, engages, affixes to, attaches to, grasps, clasps, snaps to, holds to, or the like) a grasper 124 for sandwich of shower liner 112 thereby causing grasper 124 to grasp shower liner 112. Preferred embodiments of the shower liner stay product do not require a shower liner stay wet side grasper portion 138. Grasper portions 138 fall into the following categories: inconspicuous appearance primarily for adult users, child safe size to eliminate being a choking hazard, decorative appearance to enhance aesthetic qualities as viewed from within the bathtub when taking a shower, strategically sized to minimize the number of graspers 124, and in categories for achieving the engagement to grasper 124.

When used, grasper portion 138A is a magnet, preferably coated as described above. Any magnet with enough force to sufficiently sandwich shower liner 112 when coupled to a grasper 124 is applicable. Extremely tiny Neodymium magnets have demonstrated remarkable magnetic force for their size when used on the shower liner 112 wet side. Magnets may themselves be decorative. Grasper portion 138B comprises a magnet embedded into a larger object to ensure child safety. Polyethylene foams, similar to those used in pool toys (e.g. noodles) are excellent lightweight bodies for hosting a magnet glued therein (in some embodiments no glue is required by providing a chamber (or recessed cavity) to host a magnet with a smaller access to the chamber for inserting the magnet to stay held firmly therein for being difficult to remove). Polystyrene foams and any material that is lightweight is preferable for hosting the magnet of grasper portions 138B. Grasper portion 138C is an example decorative magnet body, and child safe body, similarly designed to component 138B (preferably having a contained magnet in a recessed cavity or chamber close to the optimal contact side of body 138C). In some embodiments, a body may be formed around a magnet when manufacturing the body. A "body" is an object of a particular material with suitable dimensions, and of any appearance, colors, shapes, etc. as appropriate for a grasper portion 138. Grasper portions 1388 and 138C may host any of the grasper portion coupling methods.

Grasper portion 138D is a cap for engaging a compressed fit to grasper 124D by inserting through the disposable liner 112 tip 450 to hole 502. Tip 450 may have features as described above for matching to a chamber (or complementary cavity) at the back of hole 502 for preventing tip 450 from slipping out. In another embodiment of grasper portion 138D, a female socket 502 matches stud 414 in a loose enough manner without a shower liner 112, that with a shower liner 112 being sandwiched, there is a tight engagement without damaging shower liner 112. Polyethylene foams are excellent examples for such snap configurations. Various embodiments of components 124G and 138D comprise a male component and female component, at either side of shower liner 112, for describing preferred fittings. Male components are best held in place by providing a chamber (or recessed cavity) at the back of an entry 502 in a female component for complementing a comfortable fitting to a male component (e.g. see stud 414) so as to retain the male within the female component. Many different designs of a male snapping into a female can be provided, depending on complementary design and material (e.g. plastic) used (e.g. C clip grasper portion to circumference of rod being the grasper, or C clip grasper portion to circumference/perimeter of object on rod being the grasper).

Grasper portion 138E comprises an elongated body that can host any of the wet side grasper portion 138 methods for better holding the shower liner 112 in place. Lightweight waterproof polyethylene or polystyrene foams provide excellent lightweight bodies. For example, a single grasper 124 may be used on a pensile wand 120 at a location about half the length of support member 118. Wet side grasper portion 138E prevents more of the liner from entering the shower area by virtue of more reinforcement body coverage (i.e. more shower liner 112 area coverage) adjacent the shower liner 112 wet side. Preferably, grasper portion 138E is vertically elongated assuming there are a plurality of support members 118 in use, but any configuration, pattern, size, direction may be used. For example, a large lightweight "X" shaped body with coupling at the middle of the "X" body can require a single support member 118 dangling at the middle of the shower liner 112, and having a single grasper 124, perhaps even being a connector 202 at the middle of two rod portions 120 for double purpose. One disadvantage is a large wet side grasper that may require occasional cleaning. As already discussed, one snapping male/female engagement embodiment of grasper portion 138E is a C clip that clips (i.e. snaps) to the circumference of rod 120 for sandwiching shower liner 112, for example wherein the length of the C clip 138E is much shorter, but could still satisfy a child safe size at minimum rather than the long length of portion 138E depicted.

Grasper portion 138F comprises a C clip of appropriate (e.g. for desired flexibility) wall thickness 552 (depending on manufactured material, including Polypropylene, HDPE, LDPE, ABS, or the like) and length 554, wherein the receiving opening 556 of C clip 138F is pressed from the liner 112 wet side toward the pensile wand 120 (e.g. rod 120) for sandwiching liner 112 after C clip 138F is clipped to pensile wand 120. The top view of C clip 138F wall thickness 552 defines a profile of the C clip. Similarly, grasper portion 138G comprises a clip of appropriate (e.g. for desired flexibility) wall thickness 552 (depending on manufactured material, including Polypropylene, HDPE, LDPE, ABS, or the like) and length 554, wherein the receiving opening 556 of clip 138G is pressed from the liner 112 wet side toward the pensile wand 120 (e.g. rod 120) for sandwiching liner 112 after clip 138G is clipped to pensile wand 120. The top view of clip 138G wall thickness 552 defines a profile of the clip. Grasper portions 138F and 138G may clip to: a) a pensile wand 120 circumference or perimeter (e.g. rod 120 circumference as just described); b) a grasper 124X or 124Y, respectively (as described above) that don't freely travel/move along the pensile wand 120; or c) a grasper 124X or 124Y, respectively (as described above) that do freely travel/move along the pensile wand 120. Graspers that move freely along pensile wand 120 may facilitate opening and closing liner 112 without applying upward force at pendent terminator 122.

Figure 5B:
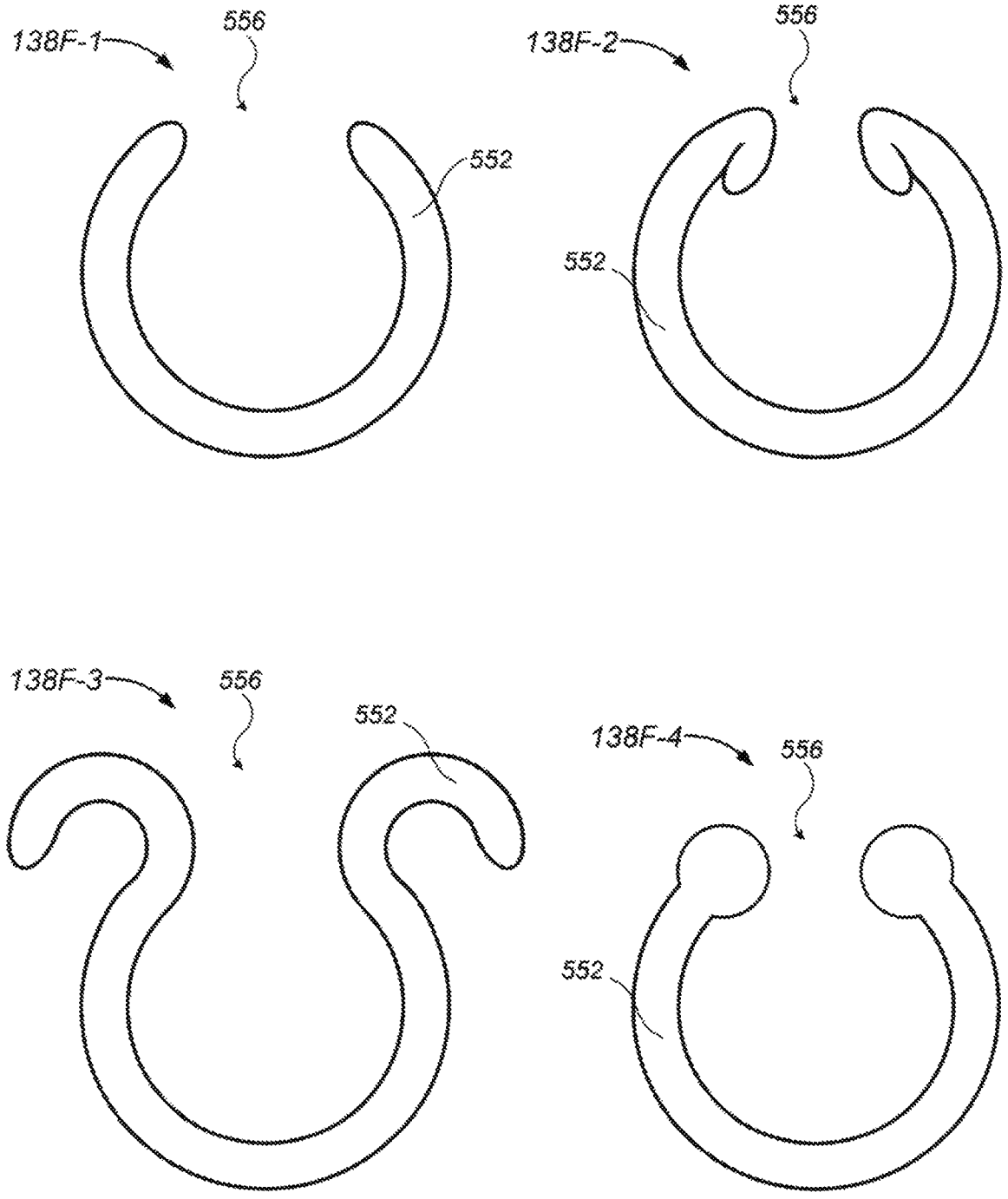

With reference now to FIG. 5B, illustrated is alternate embodiments of C clip profiles suitable for a grasper portion 138F. Profile 138F-1 comprises a conventional C configuration. Profile 138F-2 comprises a conventional C configuration with ends turned inward to the C clip inside, for example to facilitate an extrusion manufacturing process. Profile 138F-3 comprises a conventional C configuration with ends turned outward from the C clip inside, for example to facilitate a clip more easily manipulated by a user in clipping and removing. Profile 138F-4 comprises a C configuration with balled ends, for example to facilitate a clip more easily manipulated by a user in clipping and removing, and to prevent post manufacturing part tumbling for example to rid C clips of sharp edges that could result for profile 138F-1. Balled ends may be oval, or shaped as desired. Of course, any clip profile is reasonable depending on the mechanical engagement, or male to female engagement, sought (e.g. grasper portion 138F/138G mechanically engaged to grasper 124X/124Y, or grasper portion 138F/138G engaged with a male to female engagement to grasper 124X/124Y (e.g. profile view)).

Figure 6:
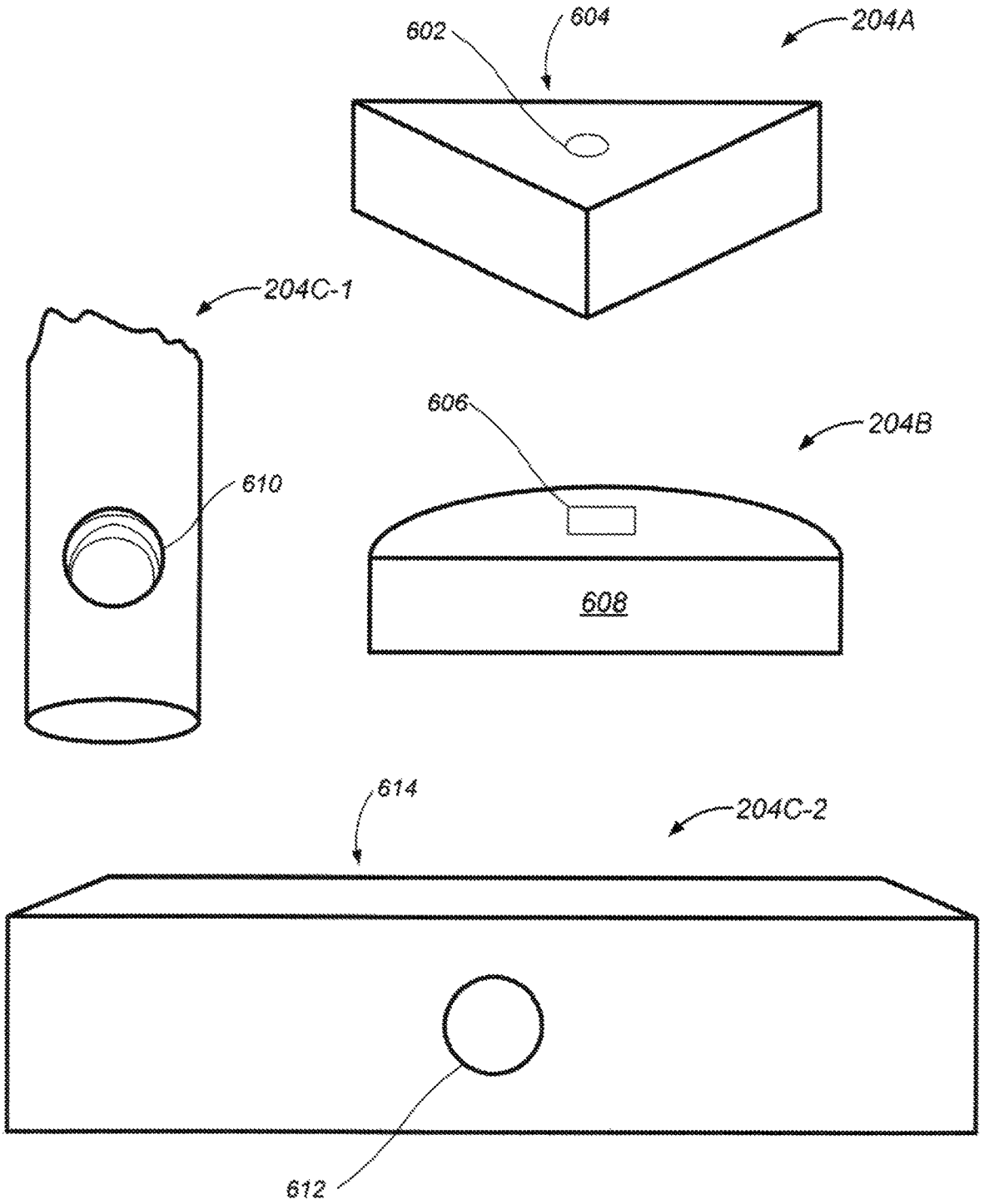
FIG. 6 illustrates alternate embodiments of shower liner stay padding entities.

FIG. 6 illustrates alternate embodiments of shower liner stay padding entities 204. Padding entity 204A is preferably a solid plastic foam (e.g. polystyrene or polyethylene foam) body with a hole 602 from top to bottom for receiving a pensile wand 120 using a to push-on tight sleeve compression fit. After support member 118 is in a comfortable gravity and reasonably plumb position, padding entity 204A can be finally adjusted so that wide face 604 contacts tub 126 in a low friction manner. Face 604 should be wide enough to enable stability preventing member 118 from turning when opening or collapsing liner 112. Similarly, padding entity 204B is preferably a solid plastic foam (e.g. polystyrene or polyethylene foam) body with a hole 606 from top to bottom for receiving a pensile wand 120 using a push-on tight sleeve compression fit and having a wide enough face 608 to enable stability preventing member 118 from turning when opening or collapsing liner 112. Dimensions and shapes of holes throughout this disclosure (e.g. 604, 606), as well as bodies described, depends on pensile wand 120 dimensions, shapes, and sizes, as well as market preferences.

Padding entity 204C includes a threaded hole 610 in the bottom of a pensile wand 120 (i.e. breakaway bottom rod 204C-1) such that the threaded hole 610 is to be perpendicular to liner 112 as anticipated by pendent terminator 122 when pensile wand 120 is in a comfortable gravity and plumb condition. A lightweight plastic screw is to be adjustably screwed into hole 610 a desired distance, while the tip of the screw is inserted into depression 612 for a very tight compression fit. Upon completion of adjusting the plastic screw (not shown) so that a desired spaced apart relation of vertical alignment 134 to vertical alignment 136 is acquired, the body 204C-2 is turned clockwise or counter-clockwise using the screw end as an axis to be parallel to the floor so that face 614 glides across the outside surface of tub 126 while providing stability to prevent turning member 118. Padding entity 204C provides adjustability for moving the shower liner 112 closer or further away from the user of the shower. Alternate embodiments, may provide other adjustment designs. For example, a sleeve (as discussed above with FIG. 2) manufactured of silicone sponge tubing (or alternatively, low durometer plastic, rubber, or like material (e.g. EDPM)) has an interesting spaced apart relation adjustment: can be stretched to be made thin, shortened to be made thicker, or compressed to add girth around the bottom of rod 120. Such sleeves may also be cut to multiple pieces for contact with multiple tub contact points. Additionally provided inside flexible tubing embodiments (e.g. silicone sponge) of entity 204 may be baking soda, corn starch, talc, a lubricant, or the like, to provide or design an optimal adjustment operation. Padding entities 204 may also be split sleeves, C-clips, or the like, for being pressed onto pensile wand 120 where needed, to rather than installed like a sleeve over the end.

In many cases, no padding entity 204 is needed. For example, support member 118 may already have a profile and material (or affixed parts) like examples in FIG. 6 wherein padding entity 204 functionality is provided. In alternate embodiments, padding entity 204 comprises a compression fit sleeve (i.e. full circumference or split sleeve (e.g. C clip, spiral wrap, spiral wrap/tubing, edge trim or edge guard piece, rubber band, silicone band/tubing, braided/mesh sleeve, rubber hose, straw, tubing, packing mesh, backer rod, fly fishing tubing, or the like)), or affixed material, of: fabric, padding, cloth, felt, plastic, or the like to maintain distance from tub 126 and/or provide a scratch proof surface and/or provide less friction (e.g. less noise for sound reduction) when opening or closing the liner 112. In child safe embodiments, padding entity 204 is sized appropriately and manufactured of a suitable material, and a screw is tightly screwed into threaded hole 610 to prevent removal. Other padding entity 204 embodiments may provide a plurality of distinct contact points with tub 126 and other adjustable designs. Still other embodiments of padding entity 204 are low cost bodies of plastic or material similarly designed like 122D and 122E, as well as descriptions thereof. Of course, the "showering area architecture edge . . . for restricting inward movement of support members 118" will be in a variety of life embodiments wherein support member 118 (e.g. pensile wand 120 and/or padding entity 204) will adapt accordingly without departing from the spirit and scope of the disclosure.

Figure 7A:
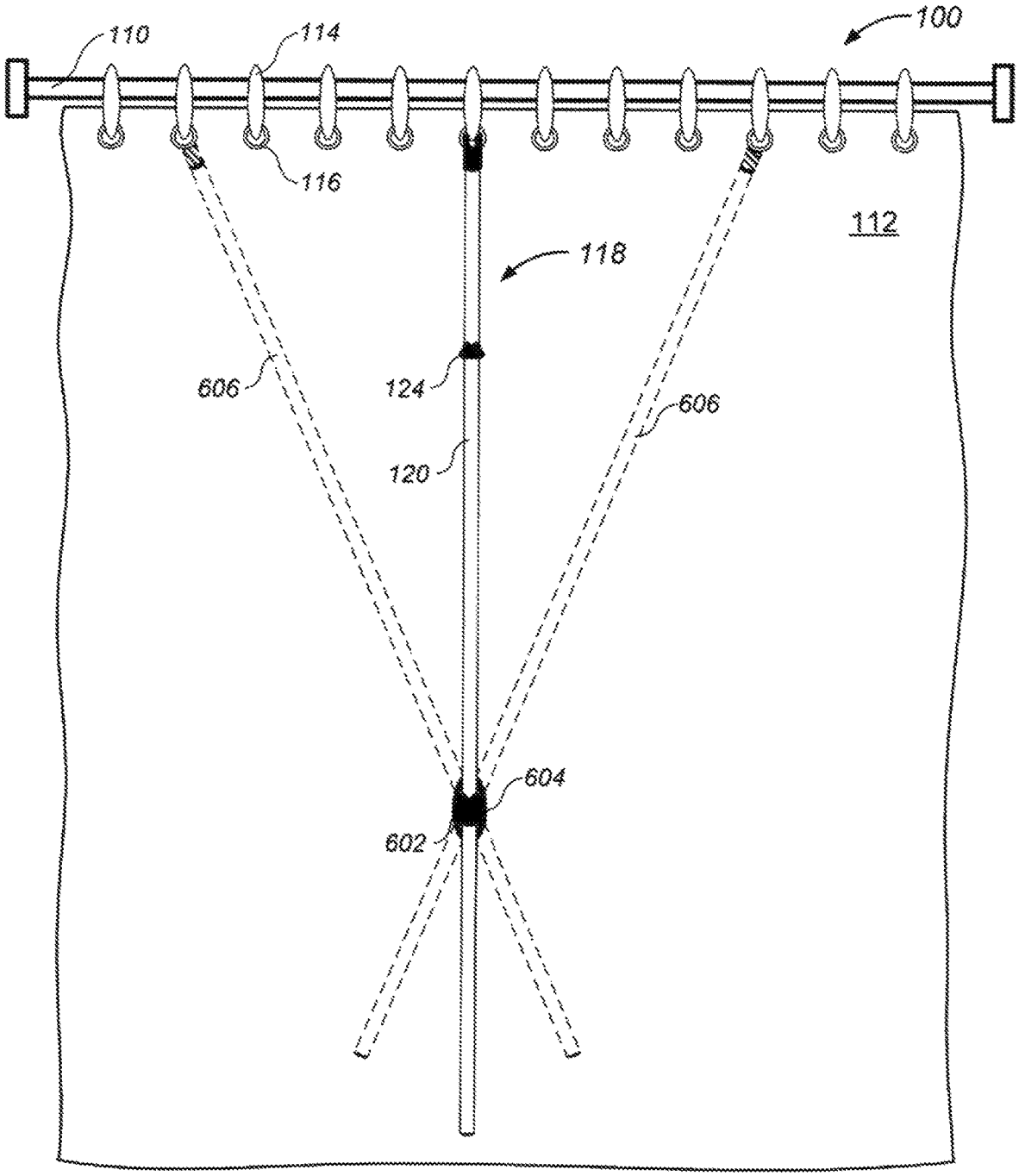
FIG. 7A depicts an alternate embodiment installation of the present disclosure.

With reference now to FIG. 7A, depicted is an alternate embodiment installation of the present disclosure. A single shower liner stay support member 118 dangles outside of the tub 126 while the shower liner 112 is inside tub 126. Strong aerodynamic conditions prevent pulling support member 118 into the tub with the shower liner 112. The bottom of support member 118 supported by the outside surface of the tub prevents shower liner 112 from being pulled toward the person taking a shower, even with the lightest materials used to make support member 118. Shower liner stay grasper 602 may be any of the embodiments discussed herein for dry side graspers 124 wherein a wet side grasper portion 138 is required. Wet side skeletal link 604 can be any of the embodiments discussed herein for wet side grasper portions 138 which couple to a particular dry side grasper 602. Skeletal link 604 is a special type of grasper portion 138 for being adapted to include a past-through guide accommodating one or more structural members 606 to installed to the wet side of shower liner 112. This design facilitates having a single grasper 602 (e.g. single magnet or ferromagnetic metal) for coupling to a special wet side skeletal link 604 (e.g. complementary magnet or ferromagnetic metal for sandwich coupling) which physically holds liner 112 in place, while providing a structural presence for structural members 606. There are aesthetic qualities to such arrangements. Structural members 606 are shown as simple pensile wands 120 with only a pendent terminator 122 for dangling on the wet side of liner 112, but there may be one or more such members 606 of different shapes, angles, and patterns. Structural members 606 may have accordion joints, may intersect or interact with each other, and may have expansion/contraction features when operated. Additional graspers 124 may not be needed at all given the arrangement of wet side structural members 606. Once installed, structural members 606 cannot exit skeletal link 604. They simply glide using skeletal link 604 as a guide when shower liner 112 is spread open or collapsed. Thus, skeletal link 604 enables a grasper-less implementation using skeletal members of any design to retain liner 112 away from the showering area. Skeletal members 606, available in alternate shapes and configurations, provide reasonable rigidity adjacent the wet side surface of liner 112 to keep liner 112 away from the showering area. Support member 118 prevents inward movement of skeletal members 606.

Figure 7B:
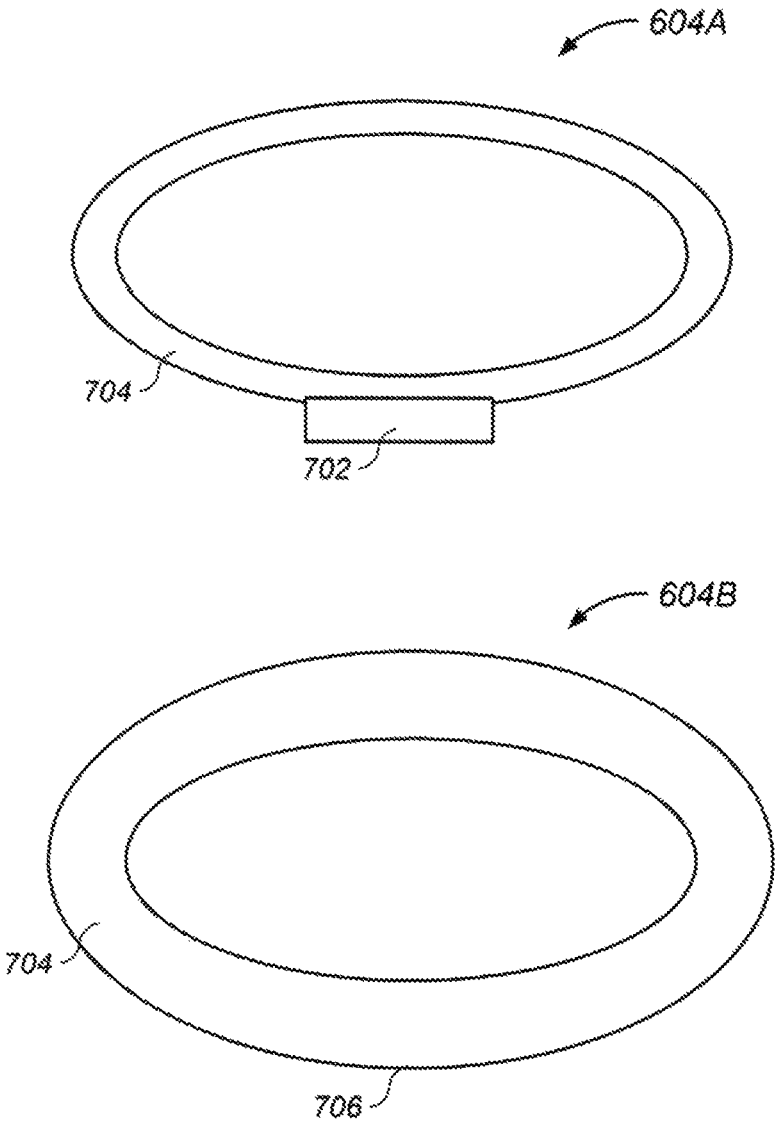
FIG. 7B illustrates alternate embodiments of shower liner stay skeletal links.

With reference now to FIG. 7B, illustrated is alternate embodiments of shower liner stay skeletal links 604 (top views). Skeletal link 604A includes a plastic ring 704 for receiving structural members 606, and includes an attached magnet 702 (e.g. glued). As a shower liner/curtain is spread open or collapsed, structural members 606 glide through ring 704 while magnet 702 (i.e. a grasper portion integrated to skeletal link 604A) is coupled to grasper 602. Turning of ring 704 is of no concern as long as magnet 702 holds the ring in place against grasper 602 of support member 118. Another embodiment is skeletal link 604B wherein magnet 702 in inserted into a chamber (or recessed cavity) of ring 704 through a smaller passageway to retain the magnet inside the body at about location 706. This requires no glue. Skeletal links 604 can be child safe. Ring 704 may be a variety of shapes, dimensions, colors, materials, etc, and could alternatively provide distinct pass-through guide rings (i.e. pass-through areas) for a plurality of structural members 606. In general, alternate shower liner stay product embodiments may use magnets on both sides of liner 112 (grasper 124 and grasper portion 138, or component 602 and component 604) to ensure a stronger attraction for sandwich of liner 112. Of course, any grasper or grasper portion embodiment disclosed herein may be used as the grasper portion integrated to a skeletal link at the wet side of shower liner 112 (e.g. C clip for fitting to rod 120, or for fitting to grasper object of rod 120 (e.g. a sleeve), wherein the C clip adapts a ring 704 or equivalent functional loop like a plastic loop, tie, cable, or the like (i.e. a ring, flexible or not) to accommodate structural member(s) 606 for operation as disclosed herein).

With reference now to FIGS. 8A through 8F, illustrated is shower liners for directly incorporating shower liner stay support members similar to those described for support members 118 (e.g. no grasper 124 (and applicable coupling portion 138) and no entity 204 required). A shower liner 112 is a flexible sheet of material for keeping water in the showering area of a shower. While the sheet of material may be of any type, predominately liners 112 are made of a flexible plastic or fiber (e.g. PVC/vinyl, PEVA/EVA, Nylon, Polyester, Cotton, Microfiber, Linen, a blend of materials, or the like). Shower liners 112 hang vertically end to end (e.g. left to right) adjacent the showering area using a variety of designs and means. A shower liner 112 typically has integrated hanging means such as grommet holes 116, integrated loops forming holes at the top of shower liner 112, integrated fasteners, integrated fastening points, or the like, for example to engage a shower curtain rod directly (e.g. thread rod through holes 116), with hooks 114, or with other couplers or fastening approaches for enabling the hanging of shower liner 112.

FIGS. 8A through 8F embodiments integrate directly to the shower liner 112 itself one or more retaining members for each retaining a minimally arranged support member 118 such as a single or coupled or telescopic pensile wand 120 (any of the embodiments discussed above) in a vertically aligned position adjacent the dry side surface of the shower liner 112 which is opposite the showering area side of the shower liner 112, thereby keeping the shower liner 112 in place during a shower and preventing the undesirable swelling of shower liner 112 during aerodynamic showering conditions. Some embodiments may also be considered retaining a pensile wand 120 in a vertically aligned position adjacent the wet side surface, or both surfaces (e.g. inside, or sandwiched by, to shower liner 112) of a shower liner 112, depending on manufacturing preference.

Figure 8A:
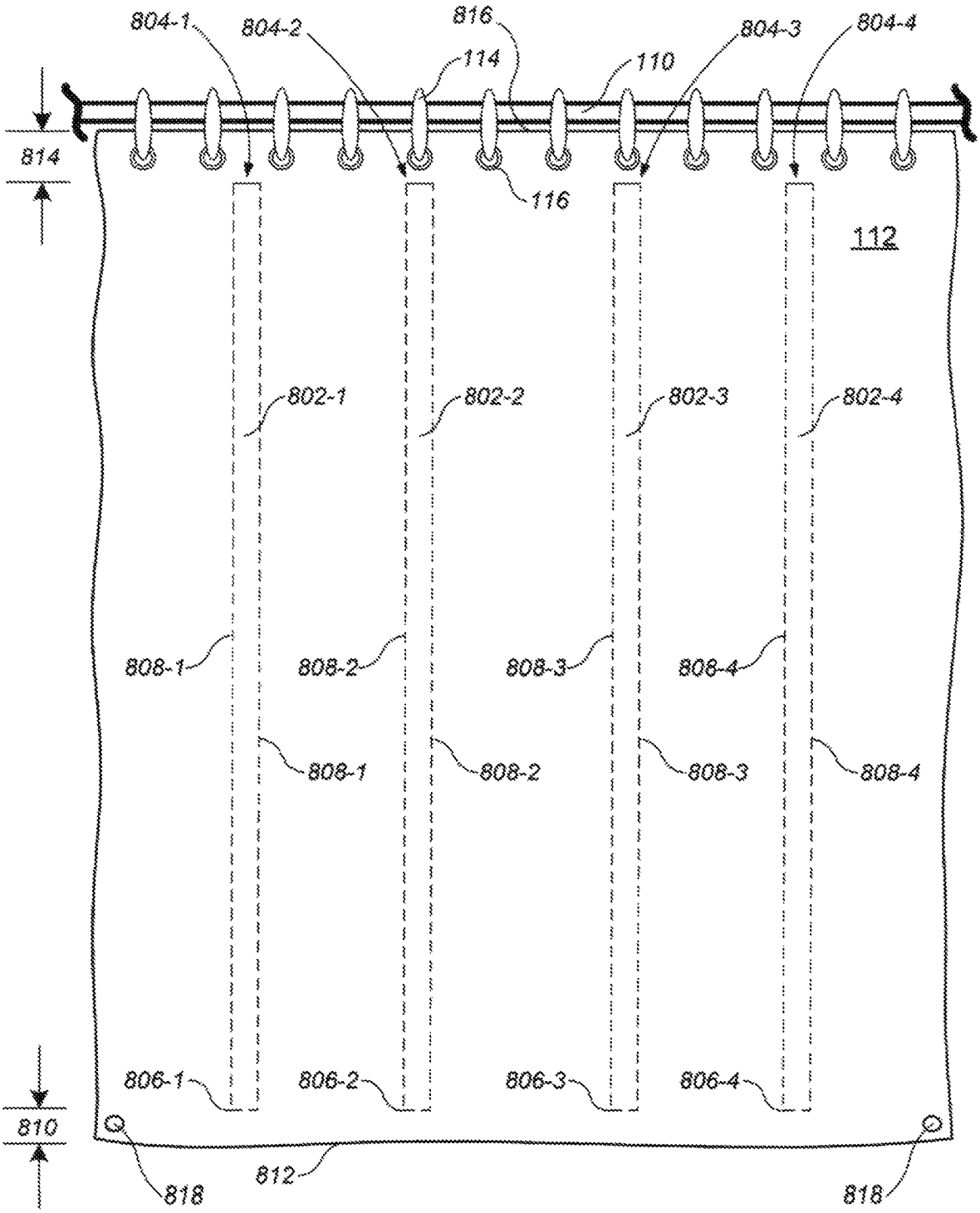
FIGS. 8A through 8F illustrate shower liners for directly incorporating shower liner stay support members.

With reference now to FIG. 8A, shower liner 112 includes integrated retaining members 802 in the form of pockets (e.g. four pockets 802-1, 802-2, 802-3 and 802-4 depicted) wherein each retaining member 802 has a top opening 804, a retaining bottom 806 (e.g. adjacent bottom seam 808), and a retaining seam 808. Seams disclosed herein, including seam 808, may be stitched, sewn, welded (e.g. heat welded plastic seams), glued, attached, fastened, riveted, a combination thereof, or a like seam, for forming an overall pocket 802, for example by using a complementary piece of attached material to form the pocket 802 for being attached (preferably with seam 808) and vertically aligned so as to accept at the opening 804 a suitable length pensile wand (e.g. rod) 120. In some embodiments, pockets 802 material is a plurality of belts, straps, bands, patches, threads, or the like for forming pocket 802 without a solid piece of attached material covering the entire pocket area. Similarly, pocket 802 may include a mesh, web, netting, or other like material with minimum material for accomplishing a pocket 802. Retaining bottom 806 vertically retains pensile wand 120 in a gravity position (e.g. seam 808 of bottom 806). There are various in-line manufacturing processes and applicable embodiments for carrying out retaining members 802: a) pocket 802 formed with seam(s) 808 (including seam 808 of bottom 806) in the sheet of shower liner 112 (e.g. at least a few spaced apart vertical seams 808, but more dense seams 808 required at bottoms 806 to retain a pensile wand 120 without a solid piece of pocket material attached (e.g. as described above)); b) pocket 802 formed by a separate piece of material and affixed to shower liner 112 with seams 808; c) pocket 802 formed by folding entirely the shower liner 112 during manufacturing for a double thickness shower liner 112 and then subsequently installing seams 808 for accepting pensile wand(s) 120 as being sandwiched between inner and outer surfaces (i.e. this embodiment would include seams not depicted at top, bottom, sides, and perhaps other places of shower liner 112 to substantially form a single shower liner 112 sheet with doubled material); or d) folding shower liner 112 material during inline manufacturing to form pockets 802 (e.g. see FIG. 8C). Bottom distance 810 between bottom 806 and shower liner bottom 812 may be zero, or some suitable design preference (e.g. a bottom left to right seam (like seam 808) above or adjacent bottom 812—e.g. a hem, weld, or the like). Top distance 814 between pocket top 804 and shower liner top 816 may be zero, or some suitable design preference (e.g. a top left to right appropriately open seam (like seam 808) below or adjacent top 816—e.g. a hem, weld, or the like). Preferably, magnets 818 are incorporated at bottom corners of shower liner 112. The weight and rigidity of pensile wands 120 installed into pockets of shower liner 112 keep shower liner 112 away from the showering user despite being in tub 126 with the shower liner 112. Another embodiment includes retaining members 802 having open bottoms 806 (e.g. no bottom seam 808) wherein the top of pensile wands 120 are retained with a disclosed pendent terminator 122 embodiment for hanging from top 804 (e.g. hook, grasper 124 embodiment to top 804 edge, or the like), curtain rod 110, hook 114, or hole 116 (e.g. bottom 806 at a substantially higher elevation for a larger distance 810, regardless of being in tub 126, or using tub 126 for support to prevent inward movement of shower liner 112 during aerodynamic conditions). Pockets 802 may complement the decorative appearance of shower liner 112 in color, pattern, seams, material, texture, or any other decorative characteristic. While retaining members 802 are depicted and symmetrically spaced from left to right, any number of retaining members may be incorporated, and any left to right position manufactured. Also, a user may select any subset of retaining members 802 prior to use for including a minimal set of preferably located pensile wands 120 as needed.

Figure 8B:
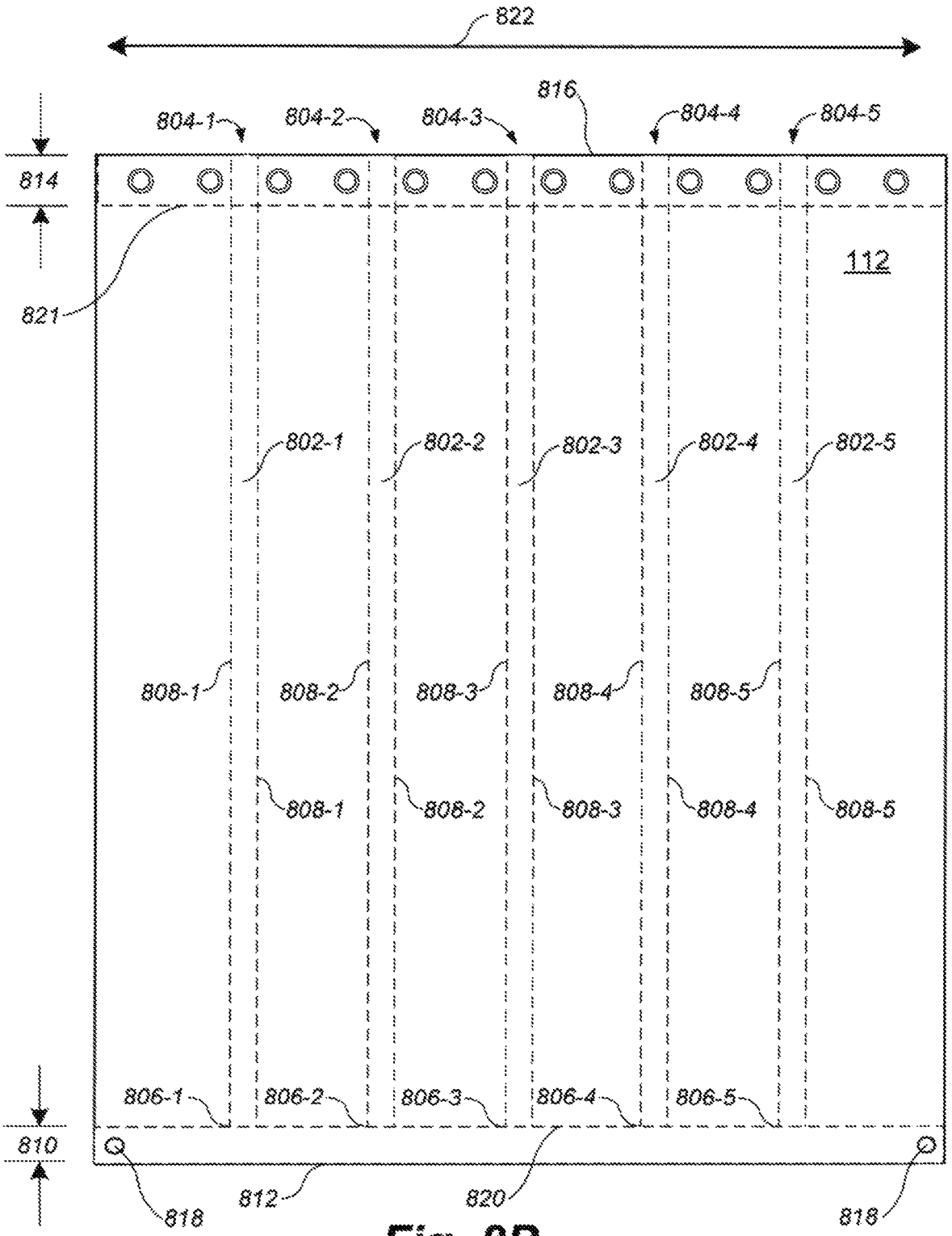

With reference now to FIG. 8B, shower liner 112 includes integrated retaining members 802 in the form of pockets as described for FIG. 8B. In-line manufacturing for carrying out retaining members 802 includes: a) pocket 802 formed by simply providing the seam 808 themselves to the sheet of shower liner 112 (e.g. few vertical seams required, but more dense seams required at bottom 806 seam 808 to retain a pensile wand 120 without a solid piece of pocket material attached (e.g. as described above)); b) pocket 802 formed by folding entirely the shower liner 112 during manufacturing for a double thickness shower liner 112 and then subsequently installing seams 808, 820, 821, a seam adjacent bottom 812, a seam adjacent top 816, and seams adjacent vertical sides of shower liner 112 (not shown); or c) folding shower liner 112 material during inline manufacturing to form pockets 802 (i.e. see FIG. 8C). Compartmentalized sections of shower liner 112 formed by seams may be incorporated (e.g. after folding or doubling) to accept weighted objects or materials at appropriate shower liner 112 locations. Bottom distance 810 between pocket to bottom 806 and shower liner bottom 812 may be zero, or some suitable design preference (e.g. a bottom left to right seam (like seam 808) above or adjacent bottom 812—e.g. a hem, weld, or the like). Top distance 814 between a pocket top and shower liner top 816 may be zero (as depicted in FIG. 8B), or some suitable design preference (e.g. a top left to right appropriately open seam (like seam 821) below or adjacent top 816—e.g. a hem, weld, or the like). Integrated retaining members 802 similarly have a seamed bottom for retaining a pensile wand 120, or alternatively have open bottoms 806 wherein the top of pensile wands are retained with a pendent terminator 122 embodiment for hanging from top 804 (e.g. hook, grasper 124 embodiment to top 804 edge, or the like), curtain rod 110, hook 114, hole 116, or a suitable hole or attachment place of shower liner 112 (e.g. near top 816).

The FIG. 8B embodiment is straightforward to manufacture in commonly available high speed in-line shower curtain and shower liner manufacturing equipment wherein the shower liner 112 material is moved through the equipment flat in a left or right manufacturing direction 822. Seams are sewn or welded (or as described above) during the in-line process to carry out retaining members 802 with seams 808 providing pockets 802, perhaps by folding shower liner 112 sheet (e.g. FIG. 8C)). Alternatively, shower liner 112 may be manufactured using in-line equipment in a perpendicular direction (i.e. perpendicular to left or right manufacturing direction 822), for example provided other shower liner 112 objects and features (e.g. grommet installations, corner magnets 818, etc) are installed conveniently using the same equipment. Pockets 802 of FIG. 8A may also be installed using in-line manufacturing processes to provide seams 808, as well as appropriate material(s), belt(s), strap(s), band(s), patch(es), thread(s), or the like for minimum pocket 802 support. Regardless of an inline manufacturing direction, seam spacing, pocket 802 material(s), or doubling/folding of shower liner 112 sheet material, pocket(s) 802 are placed appropriately and carried out to minimize in-line human resources where possible.

Figure 8C:
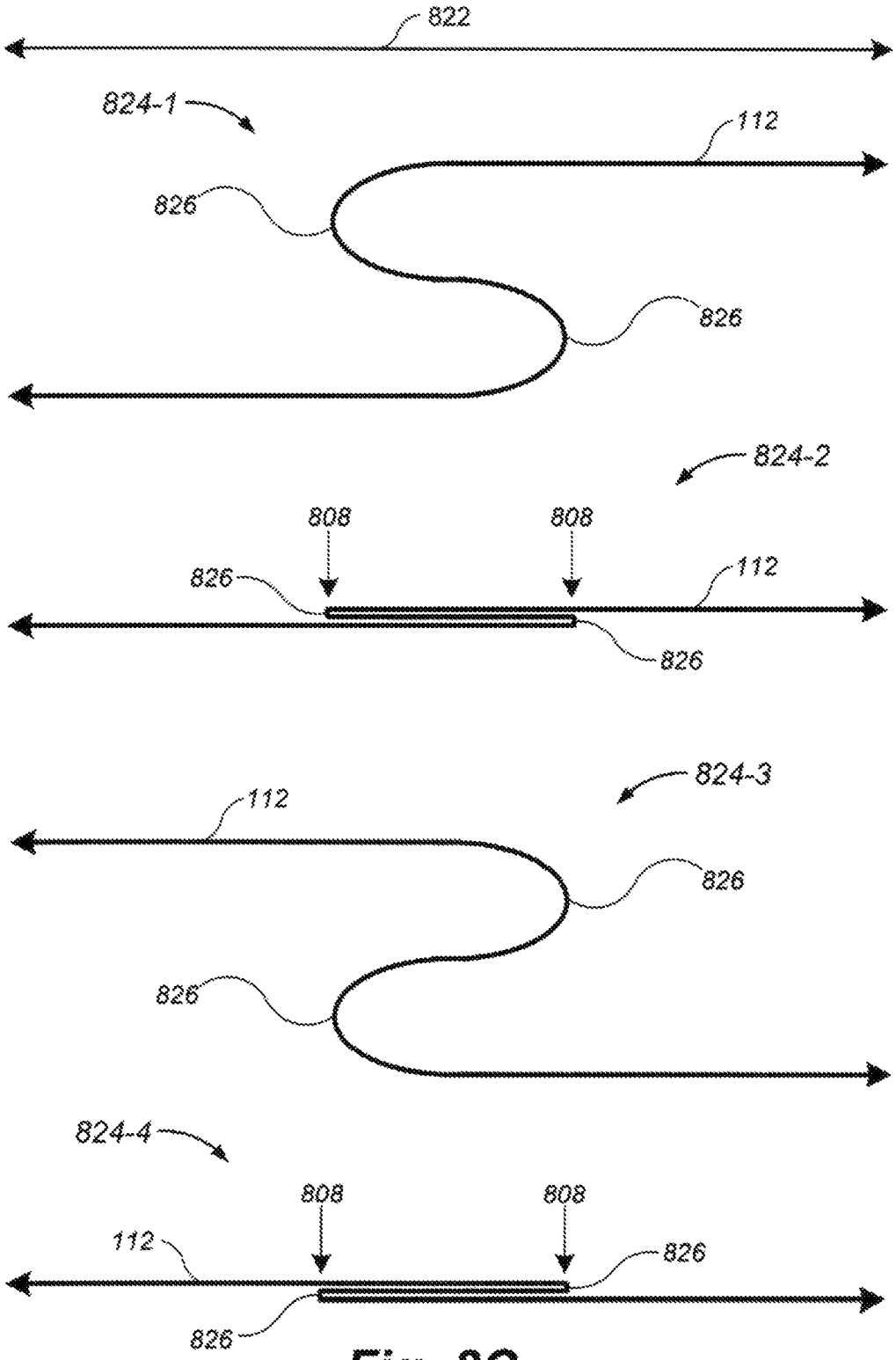

With reference now to FIG. 8C, shower liner 112 material is moved through manufacturing equipment flat in a left or right manufacturing direction 822, for example to accomplish at least four mechanical folding arrangements 824. Seams 808 are installed after folding shower liner 112 appropriately during the in-line manufacturing process, for example with fold edges 826. Fold edges 826 form material edges for adjacent seams 808 installed after the fold. Alternatively, shower liner 112 may be manufactured using in-line equipment in a perpendicular direction (i.e. perpendicular to left or right manufacturing direction 822), for example provided other shower liner 112 objects and features (e.g. grommet installations, corner magnets 818, etc) are installed conveniently using the same equipment. Thus, by simply installing seams 808 to shower liner 112, retaining members 802 in the form of pockets are provided. While seams 808 themselves provide a pocket 802, folding material or doubling material prior to installing seams 808 may provide decorative aspects, or preferred shower liner 112 qualities.

Figure 8D:
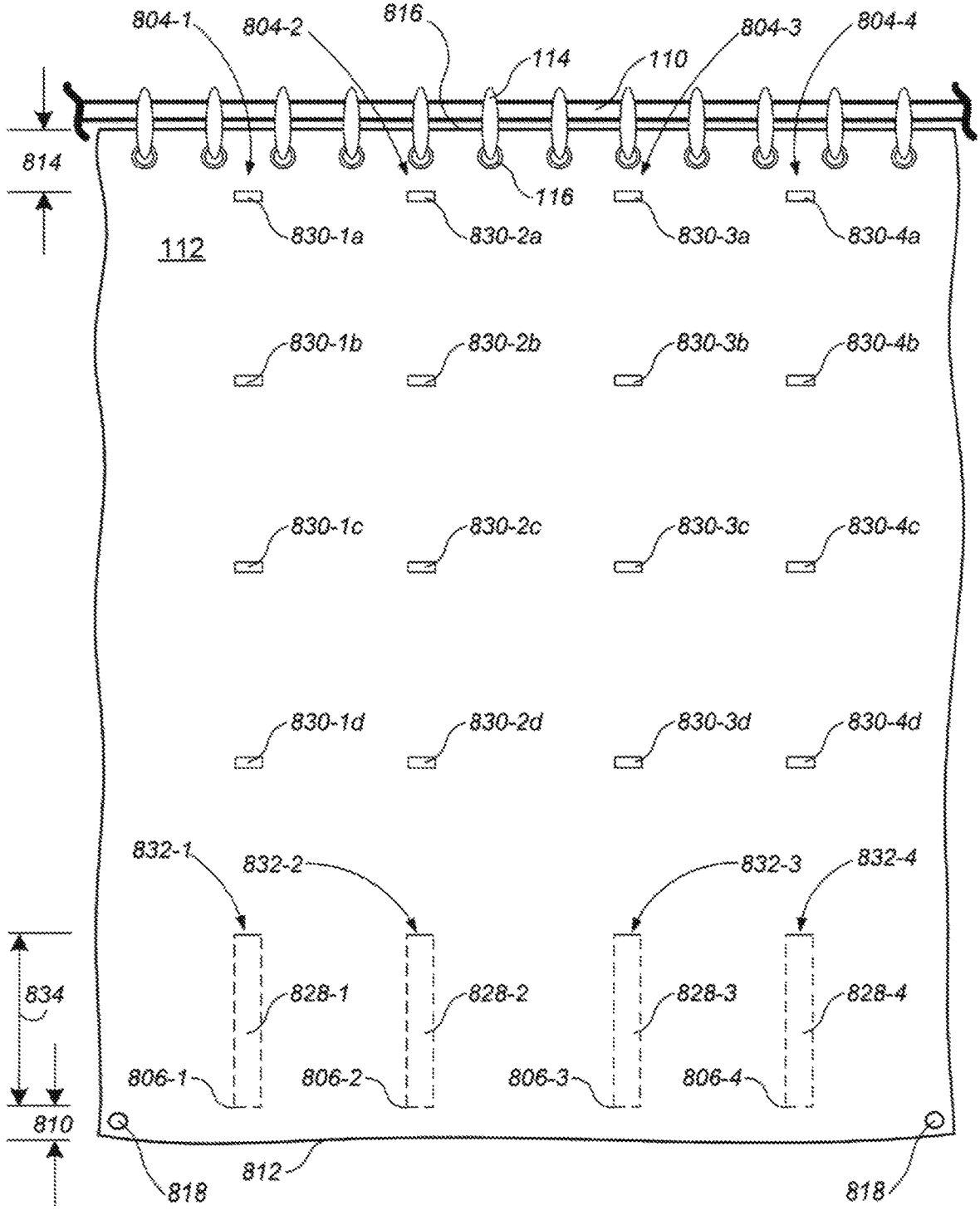

With reference now to FIG. 8D, shower liner 112 includes integrated retaining members each having a minimal retaining pocket 828 like described above and one or more loops 830 (e.g. four loops 830-1*a*, 830-1*b*, 830-1*c*, and 830-1*d*) wherein each retaining member has a top opening 804 at a top loop 830-Xa. Retaining bottom 806 vertically retains support pensile wand 120 while pocket 828 is minimal for receiving the bottom of pensile wand 120 at top opening 832. Loops 830 retain the remainder of pensile wand 120 adjacent shower liner 112 at appropriate places. Pocket(s) 828 may again be provided as described above. Loop 830 (also an eye or eyelet) may be formed with a cord, strap, belt, band, string, single thread, plurality of threads, or the like, and may have elasticity for firmly holding pensile wand 120 in place. Loops 830 may also take on any of a variety of loop, eyelet, or grasper embodiments as disclosed herein for any shower liner or shower liner stay embodiments to keep pensile wand 120 adjacent shower liner 112. There are various in-line manufacturing processes and applicable embodiments for carrying out retaining members including loops 830 and pockets 828: pocket 828 formed by an embodiment as described above for pocket 802, and loops 830 added (i.e. added at time of manufacture, or installed by a user to the shower liner 112) or improvised from folded or processed material. Bottom distance 810 between pocket bottom 806 and bottom 812 may be zero, or some suitable design preference (e.g. a bottom left to right seam above or adjacent bottom 812—e.g. a hem, weld, or the like). Top distance 814 between top loop 830 and top 816 may be zero, or some suitable design preference (e.g. loop appropriately below or adjacent top 816—e.g. a hem, weld, stitched loop, welded loop, or the like). The weight and rigidity of pensile wands 120 installed into loops of shower liner 112 keep shower liner 112 away from the showering user despite being in the tub with the shower liner. Another embodiment includes retaining members having one or more loops 830 and no pockets 828 wherein the top of pensile wands are retained with a pendent terminator 122 embodiment for hanging from top 804 (e.g. hook, grasper 124 embodiment to top 830-Xa edge, or the like), curtain rod 110, hook 114, hole 116, or a suitable hole or attachment place of shower liner 112 (e.g. near top 816). For example, before hanging pensile wand 120, it would be pushed through loops 830-2*a*, 830-2*b*, 830-2*c* and 830-2*d* (i.e. no pocket 828-2).

Figure 8E:
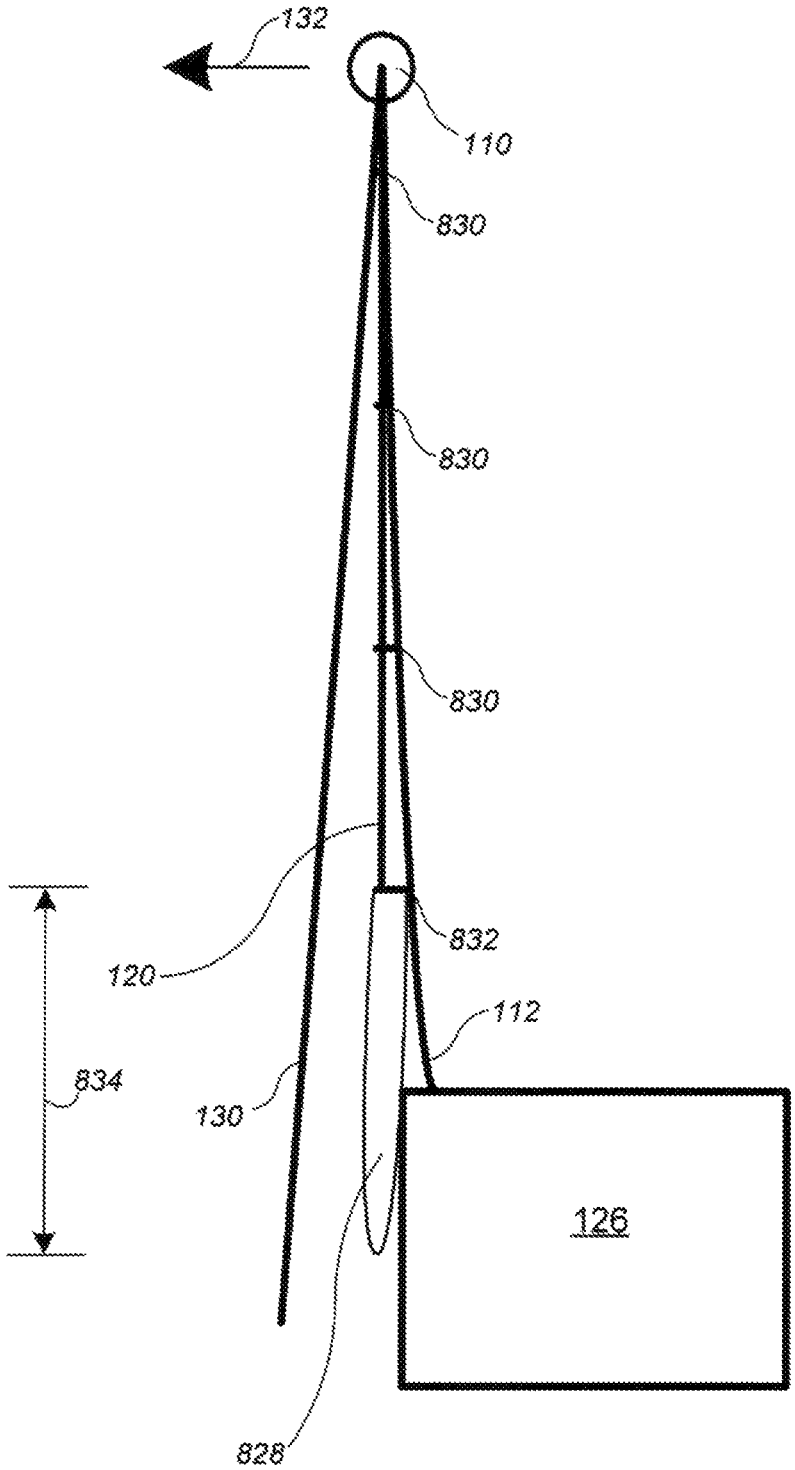

Preferred shower liner 112 embodiments ensure the bottom of lightweight and reasonably rigid pensile wands 120 remain on the outside of tub 126 for restricting inward movement of pensile wand 120 toward the showering area during aerodynamic conditions, and in turn restricting inward movement of shower liner 112 as described above (see FIGS. 1B, 1D, and discussions thereof) by: a) retaining member 802 having a bottom opening (referred to as a shower liner seam separation point) for pensile wand 120 exiting at bottom 806 at a higher elevation distance 810 wherein pensile wand 120 supported by a pendent terminator 122 is exposed to use a tub 126 edge (or similar edge) for support; b) retaining member 802 separating (referred to as a shower liner pocket separation point) from shower liner 112 at an elevation higher than distance 810 (i.e. separation length 834 (see FIG. 8F) for length of pocket 802 separated from shower liner 112) wherein pensile wand 120 is supported by a bottom 806 (i.e. no pendent terminator 122) being exposed to use a tub 126 edge (or similar edge) for support (see FIG. 8E); c) retaining member including a plurality of loops 830 (i.e. no pockets 828) wherein the loop at the lowest elevation (referred to as a shower liner loop separation point) enables pensile wand 120 exiting at a higher elevation (e.g. elevation of loop 830-1*d*) distance 810 wherein a pensile wand 120 is supported by a pendent terminator 122 so that the bottom of pensile wand 120 is exposed to use a tub 126 edge (or similar edge) for support (see FIG. 8F); or d) retaining member includes one or more loops 830 and a minimum pocket 828 that separates (referred to as shower liner pocket separation point) from shower liner 112 at a higher elevation (e.g. distance 810+ distance 834) wherein pensile wand 120 is supported by a bottom 806 of pocket 828 being exposed to use a tub 126 edge (or similar edge) for support (see FIG. 8E).

In embodiments with pensile wands 120 having pendent terminators 122, the bottommost grasping point may use any disclosed gasper embodiments, that grasper point being a shower liner grasper separation point when using a shower area (e.g. tub 126) edge for support to prevent inward movement of the shower liner 112 during aerodynamic conditions. In embodiments with a pocket bottom support for pensile wand 120, a pocket separation point provides an appropriate length pocket.

With reference now to FIG. 8E, FIG. 1D explanations are applicable in light of FIGS. 8A through 8D explanations. FIG. 8E depicts a shower liner stay side view (as viewed from wall not shown that supports curtain rod 110) of the FIG. 8 embodiment installations. Shower liner 112 is positioned inside tub 126 to ensure water stays in tub 126. Shower curtain 130 optionally installed for decorative purposes hangs outside the tub for staying dry. Pensile wands 120 dangle, or are held by at least a bottom pocket of shower liner 112, between the shower liner 112 and shower curtain 130 at a length to prevent visibility from outside the tub 126, but long enough to support the shower liner 112 using tub 126 as described above. In some retaining member 802 embodiments, a minimal retaining bottom portion pocket 828 of retaining member 802 separates from shower liner 112 (i.e. at least a bottom supporting holder embodiment for retaining pensile wand 120) at an appropriate elevation for using tub 126 to restrict inward movement of shower liner 112 during aerodynamic conditions (i.e. no applicable loops 830—see FIG. 8F). In other retaining member embodiments having nothing but loops 830, retaining member pocket 828 is not required at all because pensile wand 120 has a pendent terminator 122 for the bottom of pensile wand 120 to exit (i.e. the loop separation point) the bottom loop 830 at an appropriate elevation for using tub 126 to restrict inward movement of shower liner 112 during aerodynamic conditions (see FIG. 8F). In other retaining member embodiments having loops 830, retaining member pocket 828 is a pocket designed specifically for accommodating separation at an appropriate elevation for using tub 126 to restrict inward movement of shower liner 112 while providing a supporting bottom 806 as shown in FIG. 8E retaining member pocket 828 that separates from shower liner 112 as a true formed pocket 828 for using a shower area (e.g. tub 126) edge for support to prevent inward movement of the shower liner 112 during aerodynamic conditions.

Figure 8F:
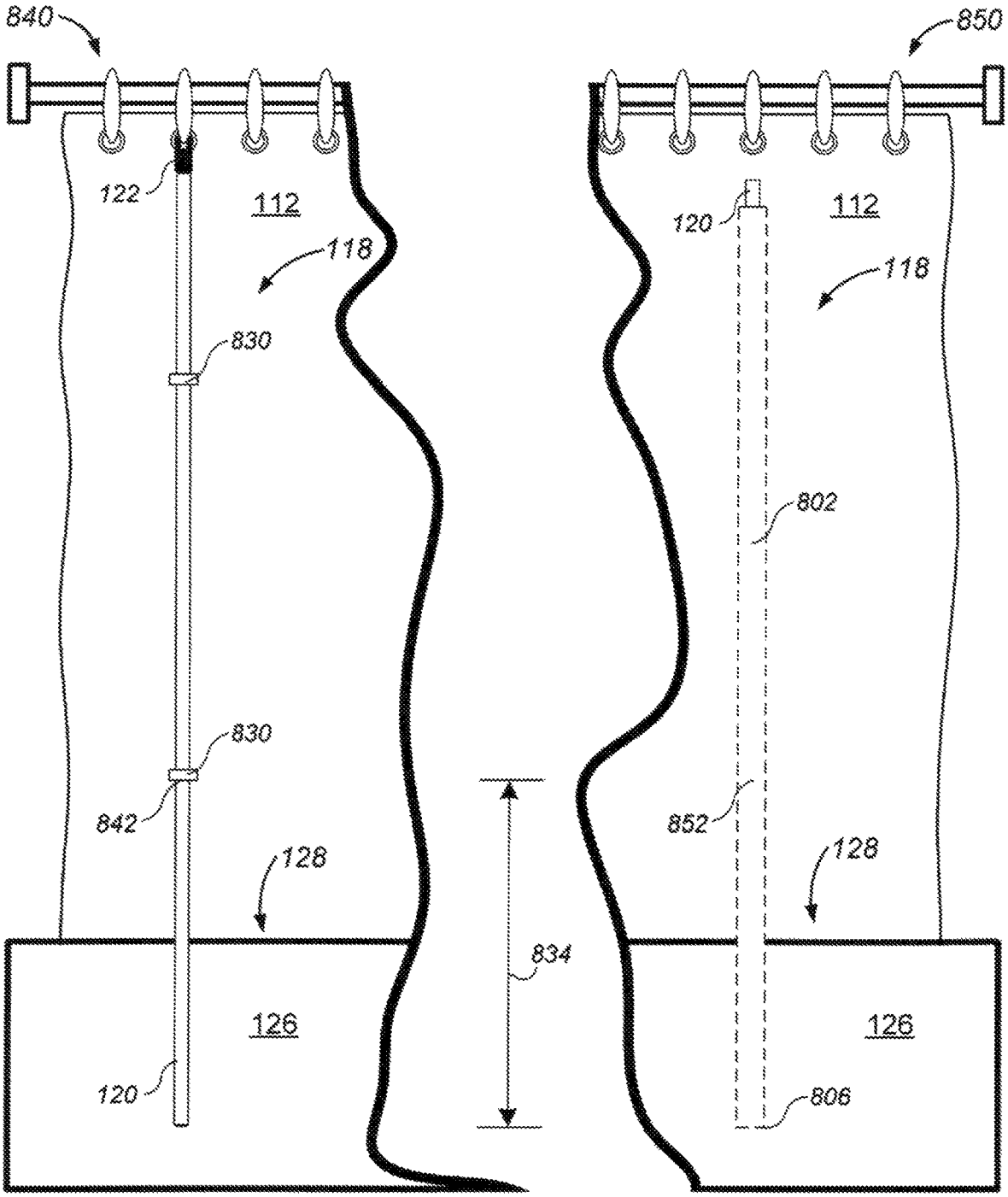

With reference now to FIG. 8F, breakaway view shower liner stay installation 840 depicts two loops 830 wherein the pensile wand 120 is hanging by pendent terminator 122, and pensile wand 120 exits at loop separation point 842 for an appropriate separation length 834 of pensile wand 120 from shower liner 112 to use the tub 126 outside (edge) for support to prevent inward movement of the shower liner 112 during aerodynamic conditions. Further depicted is breakaway view shower liner stay installation 850 depicting a pocket 802 containing and supporting (by bottom 806) pensile wand 120 wherein pocket 802 separates from shower liner 112 (like FIG. 8E) at pocket separation point 852 for an appropriate separation length 834 of pocket 802, and in turn pensile wand 120, from shower liner 112 to use the tub 126 outside (edge) to prevent inward movement of the shower liner 112 during aerodynamic conditions.

Alternate embodiments attach a pensile wand 120 to shower liner 112 with Velcro, adhesive, tape, a clip, a clamp, any grasper disclosed herein or attachment method/feature/design thereof, perhaps with user guide markings on shower liner 112, or minimal attachments (e.g. loops, clips, clamps, or the like) provided to shower liner 112, in a manner to enable the bottom of pensile wand 120 to exit at a separation point for using a shower area (e.g. tub 126) edge for support to prevent inward movement of the shower liner 112 during aerodynamic conditions. Pensile wand 120 may include a hole at the bottom to secure pensile wand 120 to a separation point adjacent shower liner 112. In fact, an upside down pendent terminator 122 (i.e. any pendent terminator 122 embodiment disclosed herein) may be included at the bottom of a pensile wand 120 (referred to as a bottom support terminator) for attaching to a separation point adjacent shower liner 112 in a similar manner, thereby providing vertical support to (gravity of) pensile wand 120.

Another embodiment has one or more separation points having material attached to shower liner 112 wherein that material is a loop, belt, strap, string, thread(s), band, conduit, or the like for attaching weights, or objects of weight to keep shower liner 112 from swelling inward. In another embodiment, there is one or more separation points having a pocket 828 attached to shower liner 112 for containing weights, sand, or objects of weight to keep shower liner 112 from swelling inward.

Company name and/or product name trademarks used herein belong to their respective companies.

While various embodiments of the present disclosure have been described above, it should be understood that they have been presented by way of example only, and not limitation. Thus, the breadth and scope of the present disclosure should not be limited by any of the above-described exemplary embodiments, but should be defined only in accordance with the following claims and their equivalents.

What is claimed is:

1. A shower liner stay installed adjacent a conventional flexible shower liner hanging from a shower curtain rod, comprising:

at least one substantially and intentionally straight pensile wand hanging vertically beneath a subjective curtain rod position by gravity with a pendent terminator, the subjective curtain rod position selected by a user of the conventional flexible shower liner from any position along the shower curtain rod, the pensile wand unenclosed by the conventional flexible shower liner beside a dry side surface of the conventional flexible shower liner and sandwiching the conventional flexible shower liner between the pensile wand and at least one grasper portion object at a wet side surface of the conventional flexible shower liner, the pendent terminator adjustably located by the user to the subjective curtain rod position and including an end cap with an eyelet installed at a top end of the pensile wand, the eyelet having a loop for the pensile wand hanging vertically beneath the subjective curtain rod position, the conventional flexible shower liner having:

the wet side surface which faces a showering area, the dry side surface which is opposite the wet side surface, and no additional design feature for physically engaging the shower liner stay; and the at least one grasper portion object:

installed by the user at the wet side surface adjacent a location of the pensile wand, enabling the sandwiching the conventional flexible shower liner between the pensile wand and the at least one grasper portion object at the wet side surface of the conventional flexible shower liner to hold in place the conventional flexible shower liner against the pensile wand at the at least one grasper portion object without direct contact of the at least one grasper portion object to the pensile wand, adjustably located by the user at the wet side surface adjacent the location of the pensile wand unenclosed by the conventional flexible shower liner beside the dry side surface of the conventional flexible shower liner, and providing the only intended engagement of the conventional flexible shower liner to the pensile wand.

2. The shower liner stay of claim 1 wherein the subjective curtain rod position is where the user hangs the pensile wand directly from the shower curtain rod.

3. The shower liner stay of claim 1 wherein the subjective curtain rod position is where the user hangs the pensile wand from a curtain rod hanger installed by the user.

4. The shower liner stay of claim 1 wherein the subjective curtain rod position is where the user hangs the pensile wand from a curtain rod hanger in use by the conventional flexible shower liner.

5. The shower liner stay of claim 1 wherein the pensile wand is comprised of a plurality of connected pensile wands.

6. The shower liner stay of claim 1 wherein the pendent terminator includes a split ring to hang the pensile wand.

7. The shower liner stay of claim 1 wherein the pendent terminator includes a compression fit to the pensile wand.

8. The shower liner stay of claim 1 wherein the end cap is flexible.

9. The shower liner stay of claim 1 wherein the sandwiching includes a compression fit object to the pensile wand.

10. The shower liner stay of claim 1 wherein the sandwiching includes an adjustably located compression fit object on the pensile wand.

11. The shower liner stay of claim 1 wherein the sandwiching includes a freely moving fit object on the pensile wand.

12. The shower liner stay of claim 1 wherein the sandwiching includes a clip coupling.

13. The shower liner stay of claim 1 wherein the sandwiching includes a magnetic coupling.

14. The shower liner stay of claim 1 wherein the sandwiching includes a male component and a female component.

15. The shower liner stay of claim 1 wherein the pensile wand includes a padding entity at the bottom of the pensile wand.

16. The shower liner stay of claim 15 wherein the padding entity is adjustable for adjusting a spaced apart relation from the showering area.

17. The shower liner stay of claim 1 including at least one skeletal member for joining at least one of the at least one grasper portion object on the wet side surface.

18. The shower liner stay of claim 1 wherein the pensile wand is made of a material of fiberglass or carbon or graphite.

19. The shower liner stay of claim 1 wherein the pensile wand includes a rod of less than 5 mm in diameter or a tube of less than 5 mm in diameter.

20. An article of manufacture installed adjacent a conventional flexible shower liner hanging from a shower curtain rod, comprising:

at least one substantially and intentionally straight pensile wand hanging vertically beneath a subjective curtain rod position by gravity with a pendent terminator, the subjective curtain rod position selected by a user of the conventional flexible shower liner from any position along the shower curtain rod, the pensile wand unenclosed by the conventional flexible shower liner beside a dry side surface of the conventional flexible shower liner and sandwiching the conventional flexible shower liner between the pensile wand and at least one grasper portion object at a wet side surface of the conventional flexible shower liner, the pendent terminator adjustably located by the user to the subjective curtain rod position and including an end cap with an eyelet installed at a top end of the pensile wand, the eyelet having a loop for the pensile wand hanging vertically beneath the subjective curtain rod position, the conventional flexible shower liner having:

the wet side surface which faces a showering area, the dry side surface which is opposite the wet side surface, and no additional design feature for physically engaging the article of manufacture; and the at least one grasper portion object:

installed by the user at the wet side surface adjacent a location of the pensile wand, enabling the sandwiching the conventional flexible shower liner between the pensile wand and the at least one grasper portion object at the wet side surface of the conventional flexible shower liner to hold in place the conventional flexible shower liner against the pensile wand at the at least one grasper portion object without direct contact of the at least one grasper portion object to the pensile wand, adjustably located by the user at the wet side surface adjacent the location of the pensile wand unenclosed by the conventional flexible shower liner beside the dry side surface of the conventional flexible shower liner, and providing the only intended engagement of the conventional flexible shower liner to the pensile wand.

* * * * *